US006479741B1

(12) United States Patent
Morton et al.

(10) Patent No.: US 6,479,741 B1
(45) Date of Patent: Nov. 12, 2002

(54) MUSICAL DEVICE HAVING MULTIPLE CONFIGURATIONS AND METHODS OF USING THE SAME

(75) Inventors: Kenneth P. Morton, East Aurora, NY (US); Kenneth G. Parker, Williamsville, NY (US); Peter F. Reile, South Wales, NY (US); Maarten Van Huystee, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/858,892

(22) Filed: May 17, 2001

(51) Int. Cl.[7] ..... G10D 15/00; G10F 1/22; G10H 1/34

(52) U.S. Cl. ..... 84/644; 84/670; 84/2; 84/171; 446/408

(58) Field of Search ..... 84/644, 670, 718–721, 84/743–746, 2, 170–172, 263, 723–742; 446/297, 397, 408

(56) References Cited

U.S. PATENT DOCUMENTS

| | | | | |
|---|---|---|---|---|
| 1,113,253 A | | 10/1914 | Schreiner | |
| 1,768,438 A | | 6/1930 | Clark | |
| 2,396,250 A | | 3/1946 | Clayman | |
| 2,546,452 A | | 3/1951 | Kmieliauskas | |
| 2,761,344 A | * | 9/1956 | Koehl | 84/171 |
| 2,858,724 A | | 11/1958 | Troppe | |
| 3,153,364 A | | 10/1964 | Ryan | |
| 3,439,570 A | | 4/1969 | Lee | |
| 3,524,377 A | | 8/1970 | Desmond | |
| 3,538,807 A | | 11/1970 | Francis | |
| 3,539,699 A | | 11/1970 | Johnson | |
| 3,550,495 A | * | 12/1970 | Shotmeyer | 84/170 X |
| 3,555,166 A | | 1/1971 | Gasser | |
| 3,589,062 A | | 6/1971 | Desmond | |
| 3,633,452 A | * | 1/1972 | Beasley | 84/263 |
| 3,659,032 A | | 4/1972 | May | |
| 3,781,451 A | | 12/1973 | Nolan | |
| 4,078,464 A | | 3/1978 | Sugiyama | |
| 4,088,050 A | | 5/1978 | Appel | |
| 4,095,503 A | | 6/1978 | Haagenson | |
| 4,254,683 A | * | 3/1981 | Nulman | 84/727 |
| 4,281,573 A | | 8/1981 | Yarema | |
| 4,301,337 A | | 11/1981 | Eventoff | |
| 4,336,734 A | | 6/1982 | Polson | |
| 4,341,146 A | | 7/1982 | Massa | |

(List continued on next page.)

FOREIGN PATENT DOCUMENTS

| | | |
|---|---|---|
| DE | 805 729 | 5/1951 |
| DE | 3519047 A1 | 12/1986 |
| FR | 2698996 A1 | 6/1994 |
| GB | 2091 020 A | 7/1982 |
| GB | 2091 470 A | 7/1982 |
| GB | 2148 575 A | 5/1985 |
| GB | 2152 727 A | 8/1985 |
| GB | 2211 342 A | 6/1989 |
| GB | 2243 239 A | 10/1991 |

*Primary Examiner*—Stanley J. Witkowski
(74) *Attorney, Agent, or Firm*—Cooley Godward LLP

(57) ABSTRACT

A musical device includes a body and at least one actuator mechanism. In one embodiment, the musical device can generate an audio output in response to activation by a user of the actuator mechanism. In one embodiment, the musical device body includes multiple parts that can be moved relative to each other. The parts enable the musical device to resemble one or more musical instruments.

31 Claims, 22 Drawing Sheets

U.S. PATENT DOCUMENTS

| | | | | | |
|---|---|---|---|---|---|
| 4,372,187 | A | | 2/1983 | Berg | |
| 4,418,598 | A | | 12/1983 | Klynas | |
| 4,430,918 | A | | 2/1984 | Meno | |
| 4,451,911 | A | | 5/1984 | Klose et al. | |
| 4,455,913 | A | | 6/1984 | Willis | |
| 4,686,882 | A | | 8/1987 | Shaw | |
| 4,738,178 | A | * | 4/1988 | Deering | 84/726 |
| 4,756,222 | A | | 7/1988 | Armato | |
| 4,757,739 | A | | 7/1988 | Yeh | |
| 4,787,876 | A | | 11/1988 | Nguyen et al. | |
| 4,790,790 | A | | 12/1988 | Todokoro | |
| 4,974,486 | A | | 12/1990 | Wallace | |
| 4,981,457 | A | | 1/1991 | Iimura et al. | |
| 4,986,792 | A | | 1/1991 | Chen | |
| 5,014,587 | A | | 5/1991 | Taylor | |
| 5,018,423 | A | | 5/1991 | Bunker et al. | |
| D324,692 | S | | 3/1992 | Milner et al. | |
| 5,095,799 | A | | 3/1992 | Wallace et al. | |
| 5,121,668 | A | | 6/1992 | Segan et al. | |
| 5,135,426 | A | | 8/1992 | Lin | |
| 5,300,729 | A | | 4/1994 | Tokunaga et al. | |
| 5,421,233 | A | | 6/1995 | Bunker | |
| 5,679,910 | A | | 10/1997 | Steinberger et al. | |
| 5,698,808 | A | | 12/1997 | Hamlin | |
| 5,994,633 | A | | 11/1999 | Norton | |
| 6,018,119 | A | | 1/2000 | Mladek | |
| 6,062,939 | A | | 5/2000 | Parker et al. | |
| 6,274,800 | B1 | * | 8/2001 | Gardner | 84/644 |

* cited by examiner

MUSICAL DEVICE HAVING MULTIPLE CONFIGURATIONS AND METHODS OF USING THE SAME

BACKGROUND OF THE INVENTION

This invention relates generally to a musical device having multiple configurations, and in particular, to a musical device that can be disposed in a first configuration resembling a first musical instrument and a second configuration resembling a second musical instrument and that can generate audio outputs associated with the musical instruments.

Some conventional musical devices can generate audio outputs that are associated with different musical instruments. Such musical devices are often limited to a single configuration, such as a keyboard. Conventional musical devices that generate these audio outputs often do not resemble the instrument associated with a particular audio output.

The need exists for a musical device that can be easily disposed in different configurations resembling musical instruments and actuated to generate audio outputs associated with the musical instruments.

SUMMARY OF THE INVENTION

A musical device includes a body and at least one actuator mechanism. In one embodiment, the musical device can generate an audio output in response to activation by a user of the actuator mechanism. In one embodiment, the musical device body includes multiple parts that can be moved relative to each other. The parts enable the musical device to resemble one or more musical instruments.

DETAILED DESCRIPTION OF THE INVENTION

A musical device includes a body and at least one actuator mechanism. In one embodiment, the musical device can generate an audio output in response to activation by a user of the actuator mechanism. In one embodiment, the musical device body includes multiple parts that can be moved relative to each other. The parts enable the musical device to resemble one or more musical instruments.

In the illustrated embodiment, the musical device includes two body parts that can be moved relative to each other. In one embodiment, the musical device includes a base and a movable member. The movable member can be disposed in a first position and a second position. When the movable member is in the first position, the musical device is in a first configuration that resembles a first musical instrument. When the movable member is in the second position, the musical device is in a second configuration that resembles another musical instrument.

In one embodiment, the musical device includes two actuator mechanisms. One actuator mechanism can be activated in the first configuration and the other actuator mechanism can be activated in the second configuration. In one embodiment, the musical device can generate audio outputs associated with each of the different instruments that it resembles.

Figure 1:
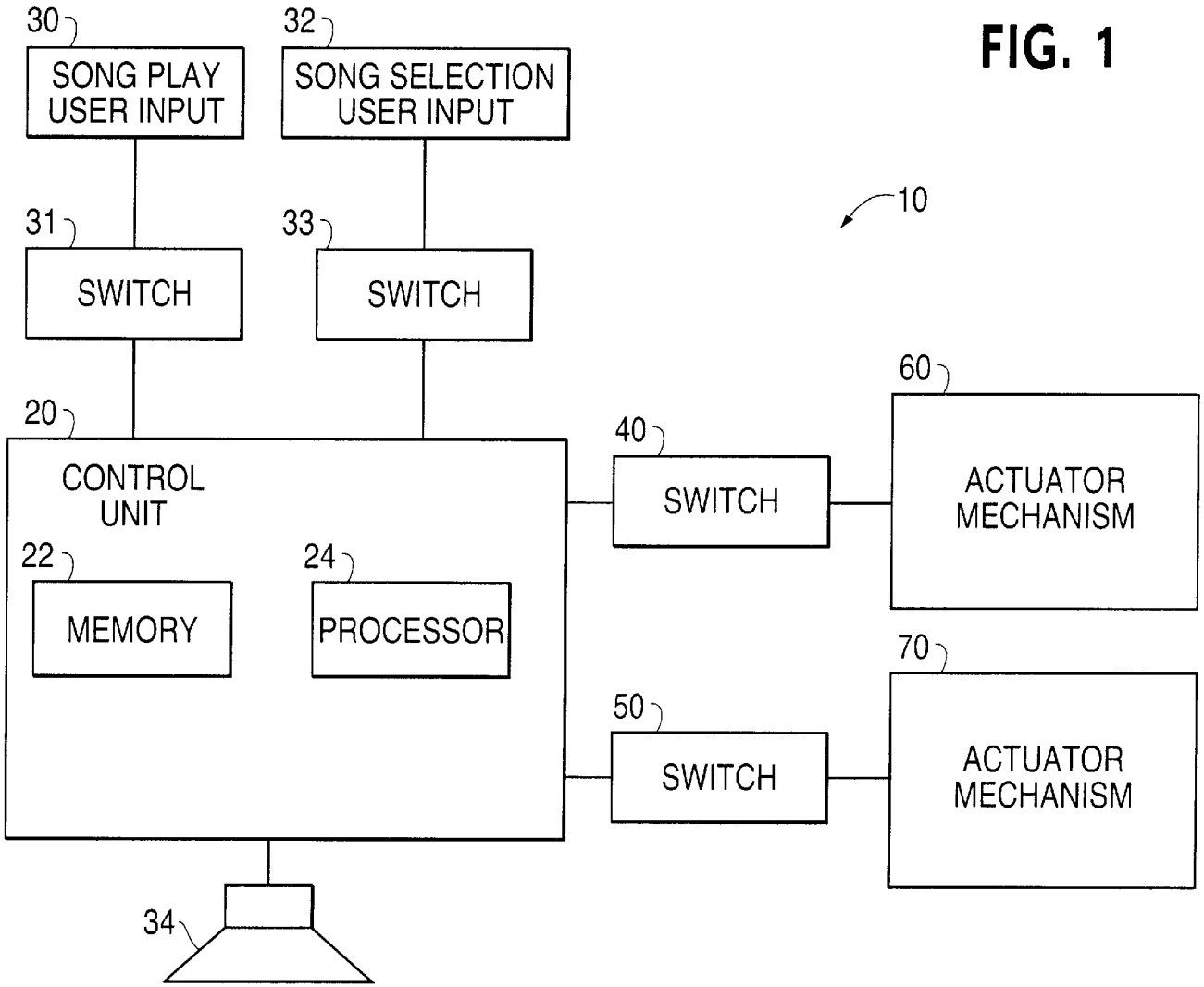
FIG. 1 illustrates a schematic view of the operational components of a musical device according to an embodiment of the invention.

A musical device according to an embodiment of the invention is illustrated in FIG. 1. FIG. 1 illustrates a schematic view of some of the functional components of the musical device 10.

In the illustrated embodiment, the musical device 10 includes a control unit 20 and actuators or actuator mechanisms 60 and 70. The actuators 60 and 70 are connected to the control unit 20, in this embodiment via switches 40 and 50, respectively. In the illustrated embodiment, the actuators 60 and 70 are connected to the control unit 20 by wiring. In other embodiments, the actuators can be connected to the control unit 20 and switches 40 and 50 using any wired or wireless connections. For example, the musical device may include an infra red receiver and transmitter, which can be used to control the musical device remotely.

In the illustrated embodiment, the control unit 20 includes a memory 22 in which pre-recorded audio outputs, such as songs and musical notes, are stored. The memory 22 can be any type of conventional memory, such as a disk drive, cartridge, or solid state memory. In the illustrated embodiment, the audio outputs are pre-recorded in the memory. In an alternative embodiment, the user may record particular audio outputs in the memory and then use the musical device to play them back.

The control unit 20 also includes a processor 24 that can access data stored in memory 22. The processor 24 can be any type of conventional processor, such as processor no. SN66060 available from Sonix. The control unit 20 also includes a power supply (not shown).

The musical device 10 includes a speaker (or other suitable audio transducer) 34 through which audio outputs can be played. In one embodiment, the musical device 10 includes a song play user input 30 and a song selection user input 32. The user inputs 30 and 32 can be movable mounted mechanisms, such as buttons which have associated switches 31 and 33 that are connected to user inputs 30 and 32, respectively.

As a user activates one of the user inputs 30 or 32, the corresponding switch 31 or 33 is closed. For example, if a user activates the song play user input 30, the song play switch 31 is closed and an appropriate signal is generated and sent to the control unit 20. Similarly, if a user activates the song selection user input 32, the song selection switch 33 is closed and an appropriate signal is generated and sent to the control unit 20.

As illustrated in FIG. 1, user inputs 30 and 32 are connected to the control unit 20. The location and function of the user inputs are described in greater detail below. While only user inputs 30 and 32 are shown, any number of user inputs may be provided on the musical device.

In the illustrated embodiment, actuator mechanism 60 is connected to the control unit 20 via switch 40. When switch 40 is closed, the actuator mechanism 60 is operably connected to the control unit 20. If switch 40 is open, then the actuator mechanism 60 is rendered inoperable.

Similarly, actuator mechanism 70 is connected to the control unit 20 via switch 50. When switch 50 is closed, the actuator mechanism 70 is operably connected to the control unit 20. If switch 50 is open, the actuator mechanism 70 is rendered inoperable. In the illustrated embodiment, only one of the switches 40 or 50 can be closed at one time. As a result, only one of the actuator mechanisms 60 or 70 is operable at a time. In an alternative embodiment, switches 40 and 50 may be configured so that both of them can be closed simultaneously, thereby providing a choice to the user as to which actuator mechanism to use.

In the illustrated embodiment, the memory 22 includes pre-recorded musical notes for two different musical instruments. When switch 40 is closed and a user activates actuator mechanism 60, the control unit 20 generates an audio output associated with a first musical instrument. When switch 50 is closed and a user activates actuator mechanism 70, the control unit 20 generates an audio output associated with a second musical instrument. In the illustrated embodiment, the first musical instrument is different from the second musical instrument. For example, the first musical instrument can be a violin and the second instrument can be a guitar. In other embodiments of the invention, the musical instruments can be a saxophone, a trumpet, a piano, a xylophone, a drum, etc.

Figure 2:
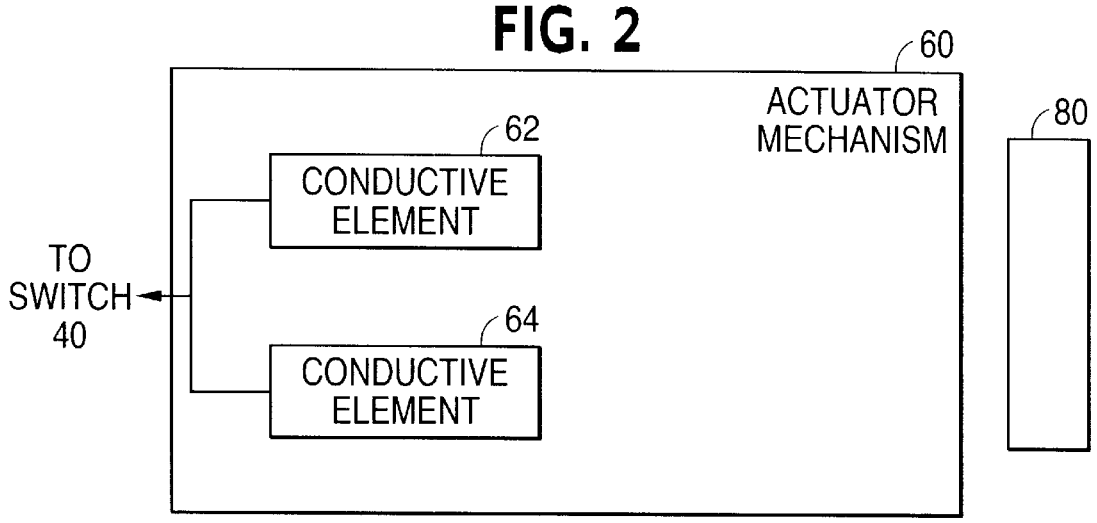
FIG. 2 illustrates a schematic view of an embodiment of an actuator mechanism of the musical device of FIG. 1.
Figure 3:
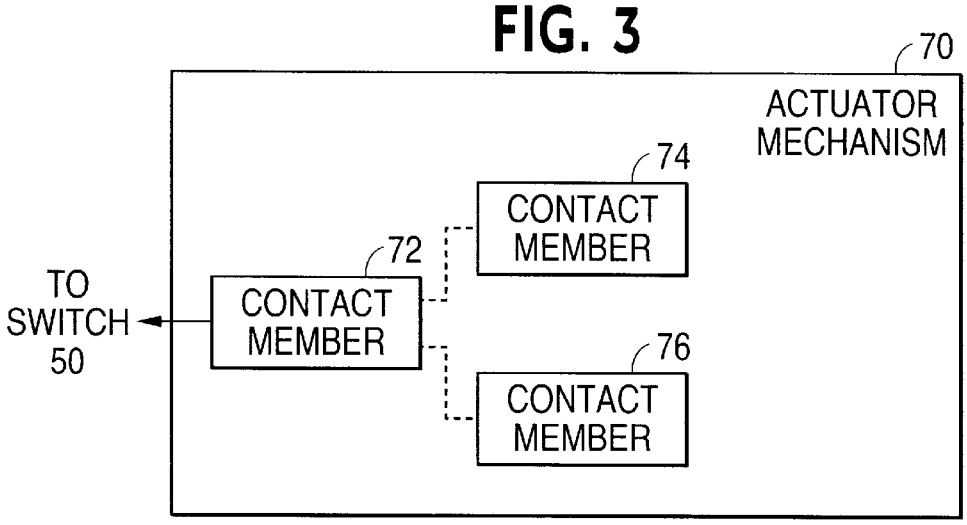
FIG. 3 illustrates a schematic view of an alternative embodiment of an actuator mechanism of the musical device of FIG. 1.

Exemplary embodiments of actuator mechanisms are illustrated in FIGS. 2 and 3. In the illustrated embodiment, actuator mechanism 60 includes conductive elements 62 and 64 as shown in FIG. 2. Conductive elements 62 and 64 are conductive wires or strings that form a switch that is closed when the elements 62 and 64 are contacted by another conductive element, such as conductive element 80. While the actuator mechanism 60 is illustrated with only two conductive elements, the actuator mechanism may include any number of conductive elements In the illustrated embodiment, when conductive element 80 is placed into contact with both conductive elements 62 and 64, the actuator mechanism 60 is activated. If switch 40 is closed, the musical device 10 generates an audio output upon the activation of the actuator mechanism 60. If switch 40 is not closed, then no audio output is generated.

Another embodiment of an actuator mechanism is illustrated in FIG. 3. Actuator mechanism 70 includes a switch 72 and contact members 74 and 76. In the illustrated embodiment, the contact members 74 and 76 are mounted for movement relative to the switch 72. Switch 72 is a push button type switch with at least two push buttons. In the illustrated embodiment, each contact member is aligned with one of the push buttons on the switch 72.

As the user presses on either contact member 74 and 76, the pressed contact member engages switch 72. If switch 50 is closed, the musical device 10 generates an audio output upon the activation of the actuator mechanism 70. If switch 50 is not closed, then no audio output is generated.

Figure 4:
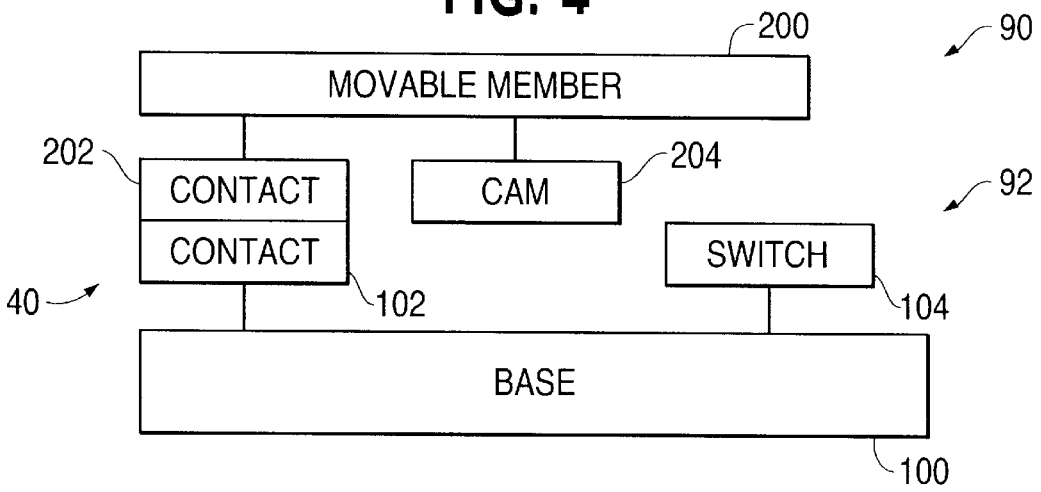
FIG. 4 illustrates a schematic view of the musical device of FIG. 1 disposed in a first configuration.
Figure 5:
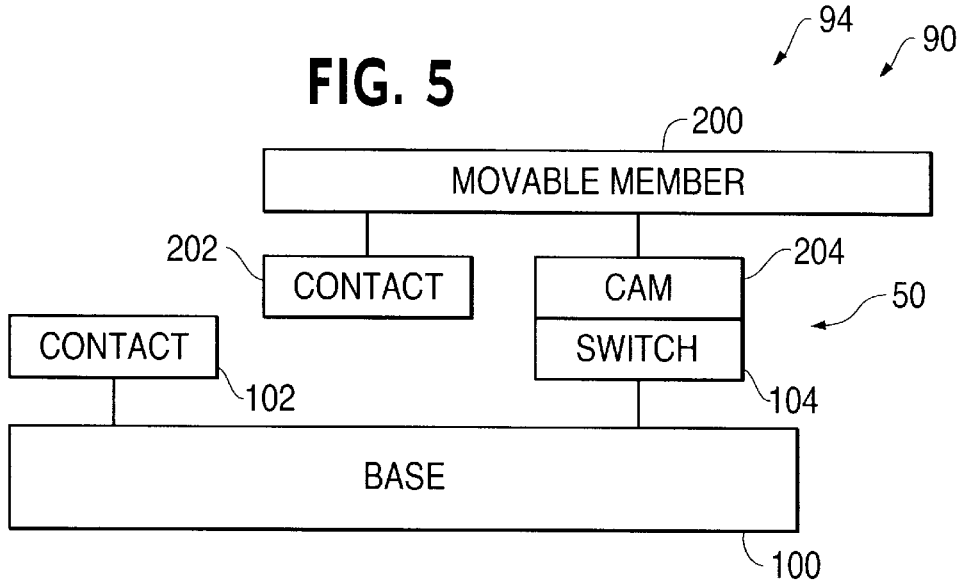
FIG. 5 illustrates a schematic view of the musical device of FIG. 1 disposed in a second configuration.

An implementation of the musical device is illustrated in FIGS. 4 and 5. In the illustrated embodiment, the musical device 90 includes a base 100 and a movable member 200. The movable member 200 is movably coupled to the base 100.

Movable member 200 is selectively disposable relative to the base 100 in a first position, as illustrated in FIG. 4, and a second position, as illustrated in FIG. 5. When the movable member 200 is in its first position, the musical device 90 is disposed in a first configuration 92, which resembles a first musical instrument. In the illustrated embodiment, the first configuration 92 resembles a violin. In alternative embodiments, the musical device may resemble any other musical instruments (e.g., a saxophone, a piano, etc.).

When the movable member 200 is in its second position, the musical device 90 is disposed in a second configuration 94. The second configuration 94 resembles another musical instrument that is different from the first configuration 92. In the illustrated embodiment, the second configuration 94 resembles a guitar. In alternative embodiments, the musical device may resemble any other musical instruments (e.g., a trumpet, a xylophone, etc.).

As illustrated in FIGS. 4 and 5, movable member 200 includes a contact 202 and a cam 204 coupled thereto. In the illustrated embodiment, contact 202 is a small piece of conductive material, such as metal, that is coupled to the movable member 200 by welding or any other conventional method.

Base 100 includes a contact 102 and a switch 104. In the illustrated embodiment, contact 102 is coupled to the base 100 and is a piece of conductive material, similar to contact 202. Switch 104 may be any conventional switch, such as a leaf spring switch or a push button switch.

As illustrated in FIGS. 4 and 5, the distance between contact 202 and cam 204 is less than the distance between contact 102 and switch 104. The difference in distance enables contacts 102 and 202 to engage each other while cam 204 and switch 104 are separated as illustrated in FIG. 4. Similarly, contacts 102 and 202 are separated while cam 204 engages switch 104 as illustrated in FIG. 5.

When the musical device 90 is in the first configuration 92, contact 102 engages contact 202 as illustrated in FIG. 4. Contacts 102 and 202 are an example of one type of structure that can be used for switch 40. When contacts 102 and 202 engage each other, the actuator mechanism 60 of the musical device 90 is operably connected to the control unit 20.

When movable member 200 is disposed in its second position, the musical device 90 is in its second configuration 94 as illustrated in FIG. 5. In this configuration 94, contact 202 is separated from contact 102 and cam 204 engages and closes switch 104. When switch 104 is closed, actuator mechanism 70 is operably connected to the control unit 20. Switch 104 is an implementation of switch 50, which connects actuator mechanism 70 to control unit 20, as previously discussed.

While contacts 102 and 202, cam 204, and switch 104 are illustrated on the movable member 200 and the base 100, any type of switch that can be closed based on the position of the movable member relative to the base can be used. Similarly, the positions of the contacts, cam, and switch may be reversed. For example, cam 204 can be coupled to the base 100 and switch 104 can be coupled to the movable member 200.

Figure 6:
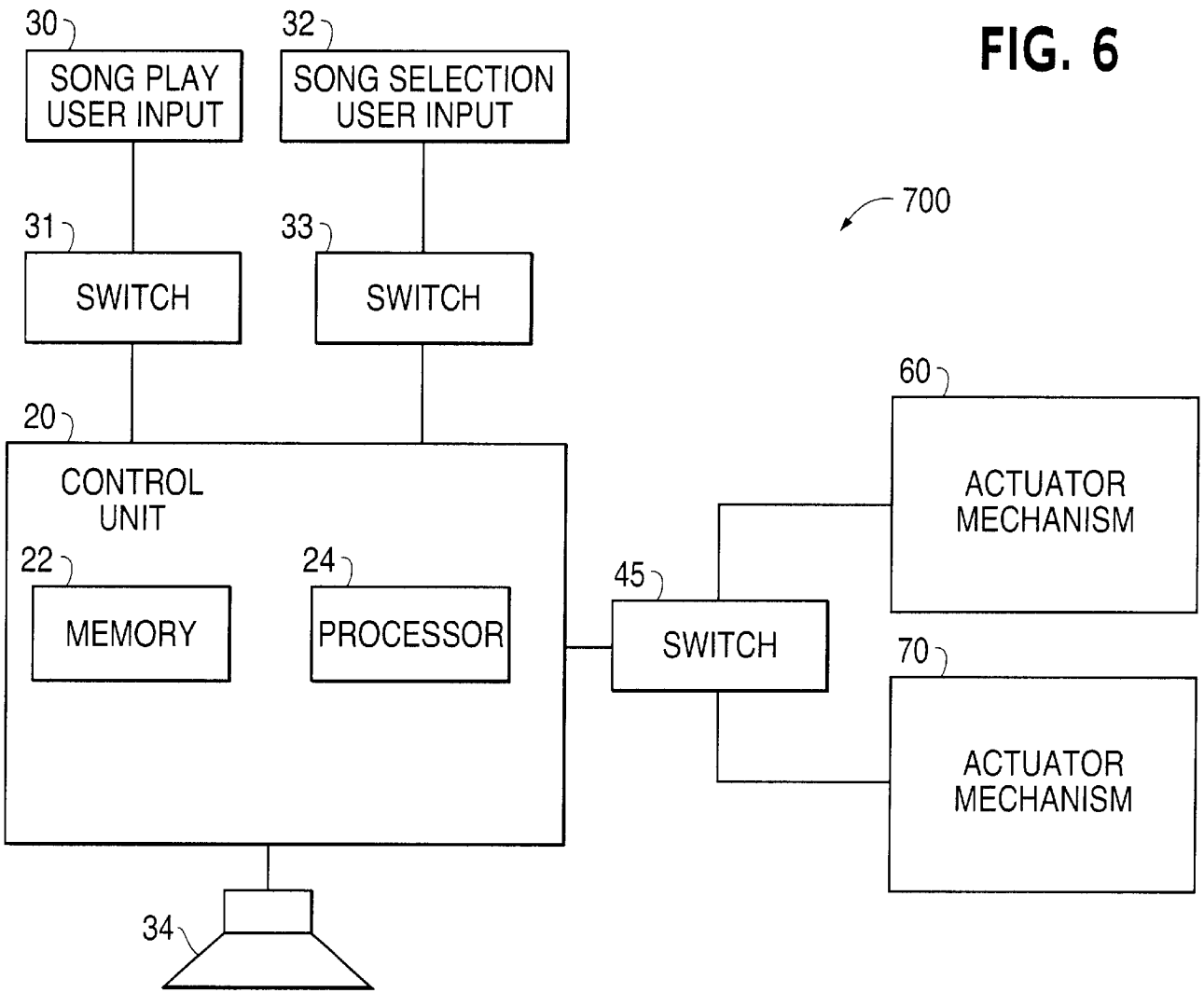
FIG. 6 illustrates a schematic view of the operational components of a musical device according to an alternative embodiment of the invention.

A musical device according to an alternative embodiment of the invention is illustrated in FIG. 6. FIG. 6 illustrates a schematic view of some of the functional components of the musical device 700. Similar reference numbers are utilized for those components of musical device 700 that are similar to components in musical device 10.

In this embodiment, the musical device 700 includes a control unit 20 and actuators 60 and 70. The actuators 60 and 70 are connected to the control unit 20, in this embodiment via switch 45. In this embodiment, the actuators 60 and 70 are connected to the control unit 20 by wiring. In other embodiments, the actuators can be connected to the control unit 20 and switch 45 using any wired or wireless connections. For example, the musical device may include an infra red receiver and transmitter, which can be used to control the musical device remotely.

As illustrated in FIG. 6, actuator mechanism 60 is connected to the control unit 20 via switch 45. When switch 45 is closed, the actuator mechanism 60 is operably connected to the control unit 20 and actuator mechanism 70 is rendered inoperable. If switch 45 is open, then actuator mechanism 70 is operably connected to the control unit 20 and actuator mechanism 60 is rendered inoperable.

Memory 22 includes pre-recorded musical notes for two different musical instruments. When switch 45 is closed and a user activates actuator mechanism 60, the control unit 20 generates an audio output associated with a first musical instrument. When switch 45 is opened and a user activates actuator mechanism 70, the control unit 20 generates an audio output associated with a second musical instrument. As discussed above, the first and second musical instruments may be any musical instrument.

In this embodiment, actuators 60 and 70 operate similar to that described above. For example, when conductive element 80 is placed into contact with both conductive elements 62 and 64, the actuator mechanism 60 is activated. If switch 45 is closed, the musical device 700 generates an audio output upon the activation of the actuator mechanism 60. If switch 45 is not closed, then no audio output is generated. Similarly, if the user presses on either contact member 74 and 76, the pressed contact member engages switch 72. If switch 45 is open, the musical device 700 generates an audio output upon the activation of the actuator mechanism 70. If switch 45 is closed, then no audio output is generated.

Figure 7:
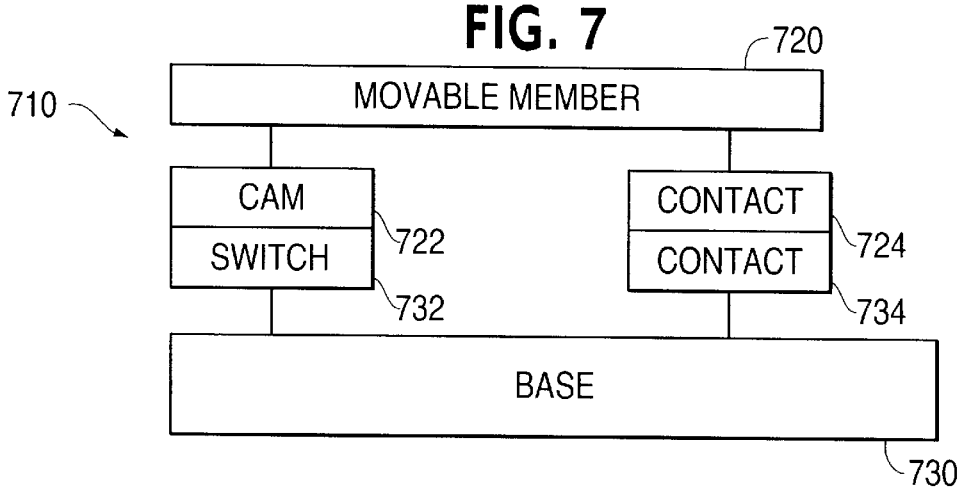
FIG. 7 illustrates a schematic view of the musical device of FIG. 6 disposed in a first configuration.
Figure 8:
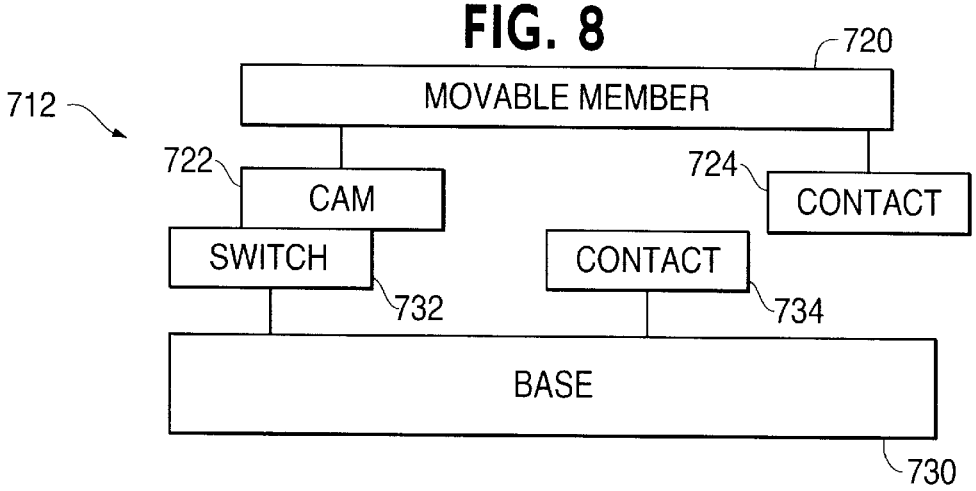
FIG. 8 illustrates a schematic view of the musical device of FIG. 6 disposed in an intermediate configuration.
Figure 9:
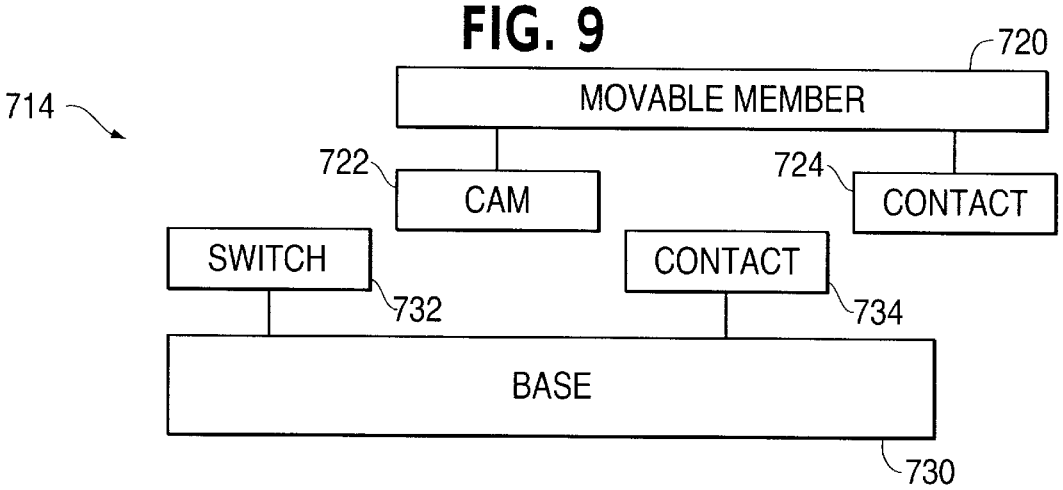
FIG. 9 illustrates a schematic view of the musical device of FIG. 6 disposed in a second configuration.

An implementation of the musical device of FIG. 6 is illustrated in FIGS. 7–9. In this embodiment, the musical device 700 includes a base 730 and a movable member 720. The movable member 720 is movably coupled to the base 730.

Movable member 720 is selectively disposable relative to the base 730 in a first position, as illustrated in FIG. 6, an intermediate position, as illustrated in FIG. 8, and a second position, as illustrated in FIG. 9. When the movable member 720 is in its first position, the musical device 700 is disposed in a first configuration 710, which resembles a first musical instrument.

When the movable member 720 is in a second position (see FIG. 9), the musical device 700 is disposed in a second configuration 714. The second configuration 714 resembles another musical instrument that is different from the first configuration 710.

When the movable member 720 is in an intermediate position (see FIG. 8), the musical device 700 is disposed in an intermediate configuration 712. The intermediate configuration 712 may resemble either the musical instrument of the first configuration 710 or the musical instrument of the second configuration 714, depending on the relative positions of the movable member 720 and the base 730.

As illustrated in FIGS. 7–9, movable member 720 includes a contact 724 and a cam 722 coupled thereto. In this embodiment, contact 724 is a small piece of conductive material, such as metal, that is coupled to the movable member 720 by welding or any other conventional method.

Base 730 includes a contact 734 and a switch 732. In this embodiment, contact 734 is coupled to the base 730 and is a piece of conductive material, similar to contact 724. Switch 732 may be any conventional switch, such as a leaf spring switch or a push button switch.

When the musical device 700 is in the first configuration 710 as illustrated in FIG. 7, contact 724 engages contact 734. Also in this configuration cam 722 engages switch 732 disposed on base 730. Switch 732 is illustrative of a switch that can be used as switch 45 in FIG. 6. When contacts 724 and 734 engage each other and cam 722 engages switch 732, actuator mechanism 60 of the musical device 700 is operably connected to the control unit 20.

When movable member 720 is moved along base 730 and disposed in an intermediate position as illustrated in FIG. 8, the musical device 700 is in an intermediate configuration 712. In this configuration 712, contact 724 is separated from contact 734, rendering actuator mechanism 60 inoperable. However, switch 732 is still engaged by cam 722 and is closed. Since switch 732 is closed, actuator mechanism 70 is inoperable as well.

In one embodiment, the cam 722 is not continuously coupled to the movable member 720. For example, the movable member 720 has to move a particular distance before the cam 722 is engaged by and coupled to the movable member 720 to move along therewith. Accordingly, the cam 722 does not move away from switch 732 until the movable member 720 has moved a certain distance along the base 730. In one arrangement, once the movable member 720 moves approximately three-quarters of its range of movement along the base 730, the cam 722 engages the movable member 720 and subsequently disengages from the switch 732. The particular distance of travel of the movable member 720 before movement of the cam 722 can vary.

When the cam 722 disengages from switch 732, the musical device 700 is in its second configuration 714 as illustrated in FIG. 9. In this configuration 714, cam 722 and contact 724 do not engage switch 732 and contact 734, respectively. When switch 732 is open in this configuration 714, the actuator mechanism 70 of the musical device 700 is operably connected to the control unit 20.

Figure 10:
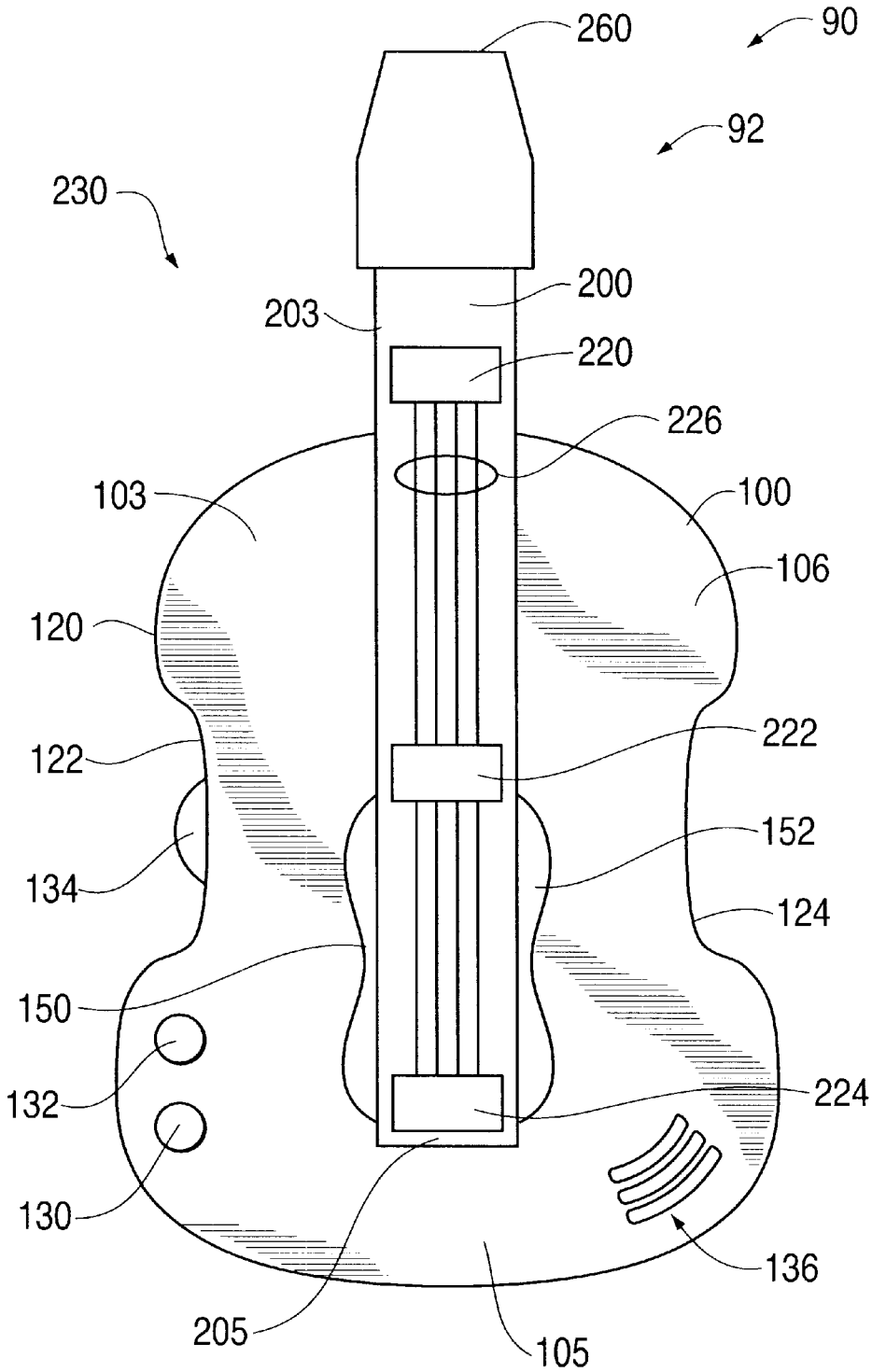
FIG. 10 illustrates a top view of an embodiment of a musical device embodying the principles of the invention disposed in a first configuration.

An implementation of a musical device embodying the principles of the present invention is illustrated in FIGS. 10–20. In FIG. 10, the musical device 90 is illustrated in its first configuration 92, in which it resembles a violin. The musical device 90 includes a base 100 a nd a movable member 200 movably coupled thereto. In this embodiment, the base 100 resembles the body of a violin and the movable member 200 resembles a neck of a violin. In the illustrated configuration, the movable member 200 is disposed in its first or retracted position 230.

Figure 11:
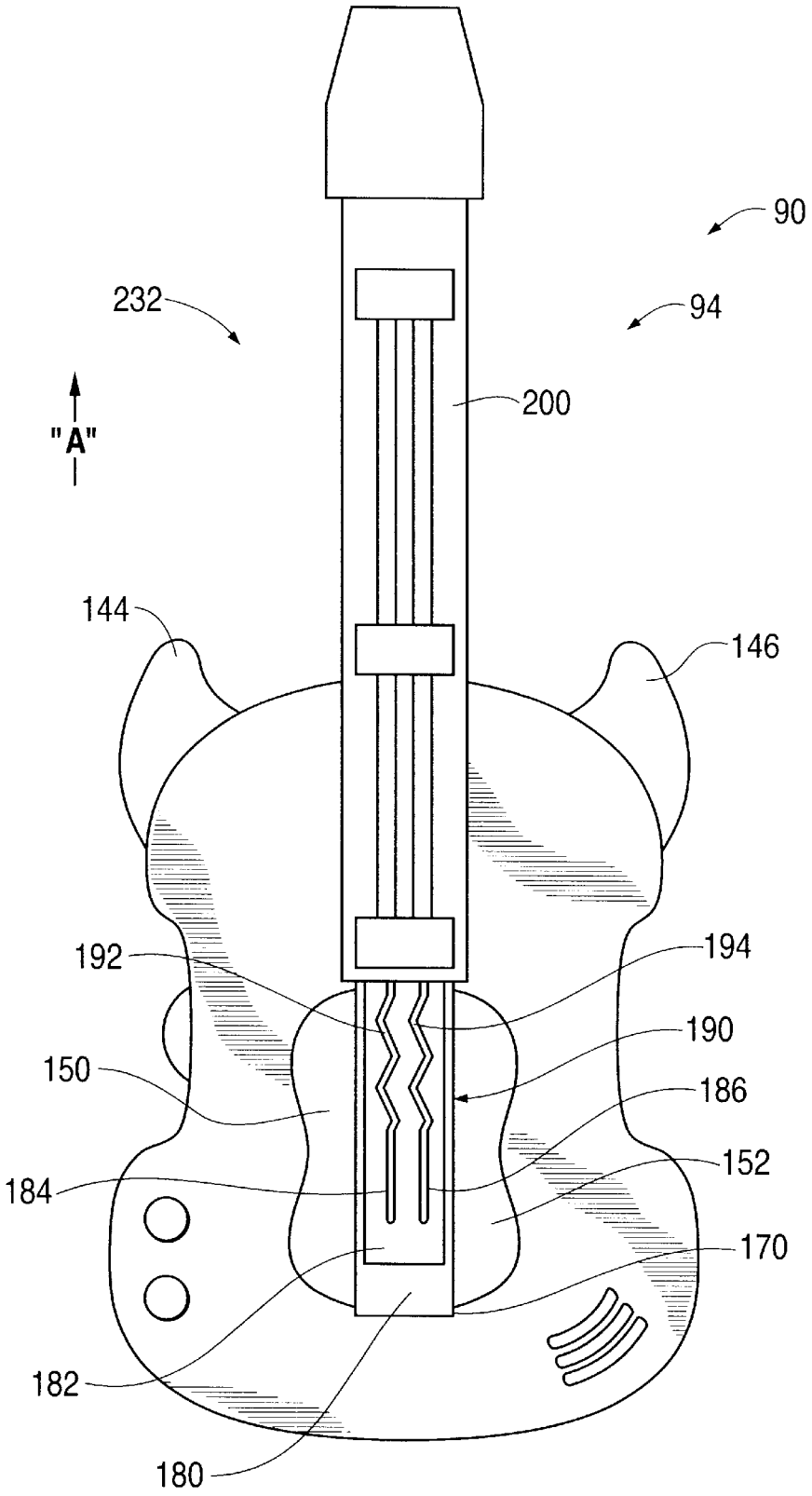
FIG. 11 illustrates a top view of the musical device of FIG. 10 disposed in a second configuration.

In FIG. 11, the musical device 90 is illustrated in its second configuration 94, in which it resembles a guitar. In this configuration, the movable member 200 is disposed in its second or extended position 232. The movable member 200 is moved along the base 100 from its first position 230 to its second position 232 along the direction of arrow "A."

In the illustrated embodiment, the base 100 includes detents (not shown) that are engaged by a ball or roller (not shown) on the movable member 200 when the movable member 200 is in its first and second positions 230 and 232, respectively. The roller/detents arrangement is used to hold the movable member 200 in its first and second positions 230 and 232. Note that any suitable structure that provides sufficient force to retain the movable member in a position relative to the base can be utilized to perform this function.

In order to change the musical device 90 from one configuration to another configuration, the movable member 200 is pushed or pulled in the appropriate direction, with sufficient force to disengage the roller from a detent. For example, if the movable member 200 is in its first position 230, the user pulls the movable member along the direction of arrow "A" in FIG. 1. When the movable member 200 is fully extended and is disposed in its second position 232, the roller engages the other detent on the base 100. As a result, the movable member 200 is retained in its second position 232.

Referring to FIG. 10, base 100 includes a first end 103 and a second end 105. The base 100 also includes an upper surface 106, a lower surface 108 (not shown), and a perimeter 120 as defined by side surfaces. In the illustrated embodiment, the perimeter 120 is shaped so as to resemble a body of a violin or guitar.

In the illustrated embodiment, the upper surface 106 of the base 100 includes openings 136 located proximate to a speaker 34 (not shown) disposed inside the base 100. Audio output from the speaker 34 passes through the openings 136 so the user may hear the generated output.

In one embodiment, the musical device 90 includes a song demo button 130 and a song select button 132 disposed in openings formed in the upper surface 106 of the base 100. The musical device 90 also includes concave portions 122 and 124 located along its perimeter 120. A power and volume control mechanism 134, such as a rotatably mounted knob, is disposed in an opening in the base 100 within concave portion 122.

In one embodiment, the musical device 90 includes decorative plates 150 and 152 that are movably coupled to the base 100. The plates 150 and 152 are disposable in two different positions as the movable member 200 moves between its retracted and extended positions. The movement of plates 150 and 152 is described in greater detail below.

The movable member 200 includes ends 203 and 205. A head 260, resembling the head piece of a guitar, is coupled to end 203. The movable member 200 includes fret bars 220, 222, and 224 and conductive elements 226 mounted to fret bars 220 and 224. In the illustrated embodiment, conductive elements 226 are metal wires or strings.

In the illustrated embodiment (see FIG. 11), the musical device 90 includes a support 170 that extends along a portion of the upper surface 106 of the base 100. The support 170 includes an upper surface 180 that defines a cavity 182 with grooves 184 and 186.

The musical device 90 includes an actuator mechanism 190 that includes contact members 192 and 194. A user can press or move contact members 192 and 194 to activate the actuator mechanism 190 to produce an audio output. In the illustrated embodiment, the contact members 192 and 194 are disposed in grooves 184 and 186, respectively. The operation of actuator mechanism 190 is discussed in greater detail below with respect to FIGS. 16–17.

While two contact members with zig-zag shapes are illustrated, any number of grooves and contact members with any shape, such as curves, straight sections, etc., can be used in the discussed actuator mechanism.

As illustrated in FIGS. 10 and 11, the movable member 200 covers actuator mechanism 190 when the movable member 200 is disposed in its first position 230. As the movable member 200 moves along the base 100 along direction "A", the actuator mechanism 190 is uncovered.

In one embodiment, the musical device 90 includes wings 144 and 146 that are pivotally coupled to the base 100. The wings 144 and 146 are operably coupled to the movable member 200 so that they move as the movable member 200 moves. As the movable member 200 moves from its retracted position 230 to its extended position 232, the wings 144 and 146 are pivoted from a retracted position within the base 100 (see FIG. 10) to a position extending from the base 100 (see FIG. 11).

Figure 12:
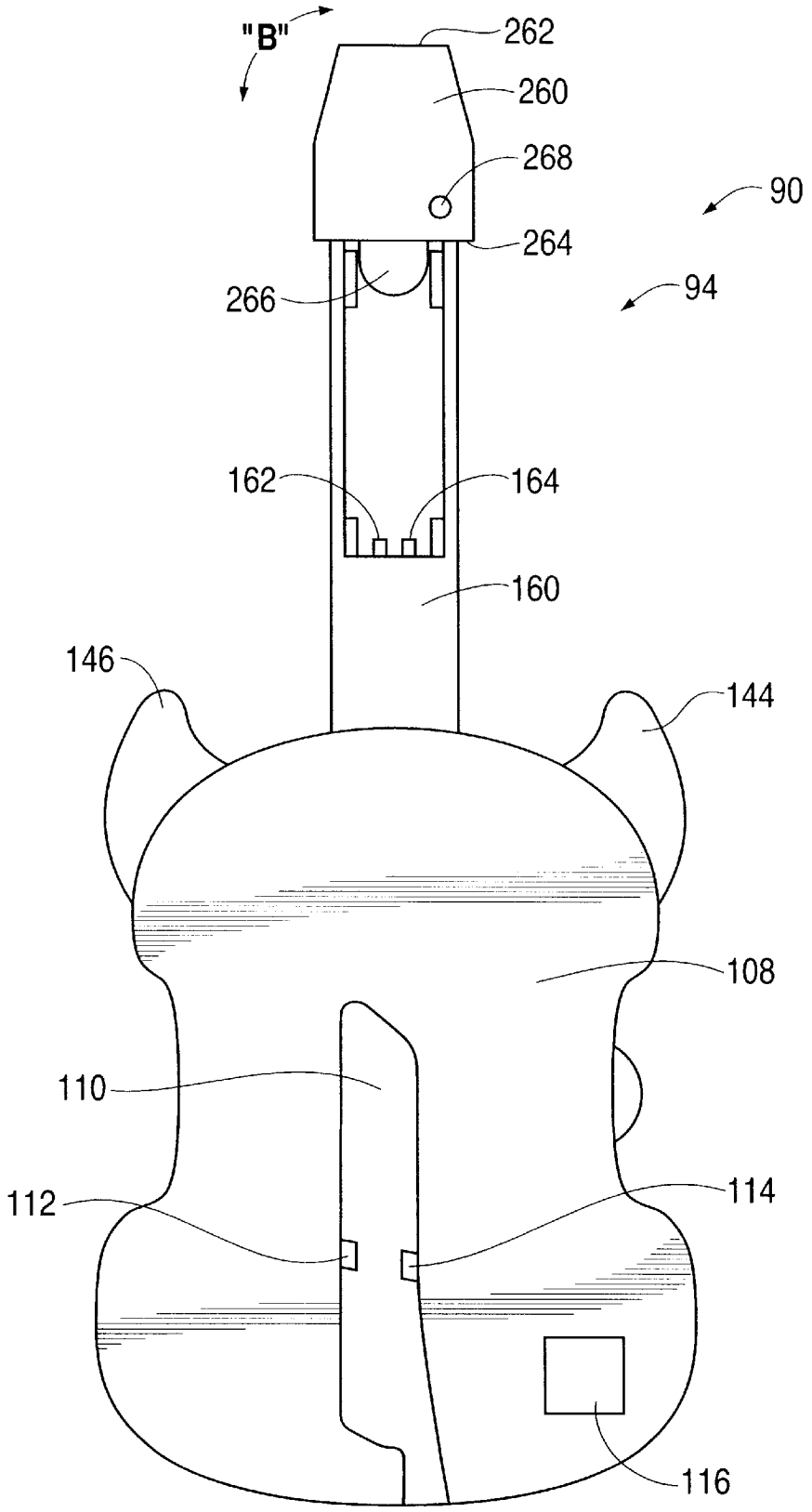
FIG. 12 illustrates a bottom view of the musical device of FIG. 11 disposed in a second configuration.

A bottom view of the musical device 90 in its second configuration 94 is illustrated in FIG. 12. The bottom surface 108 of the base 100 includes a cavity 110 defined therein for storage of a conductive element, such as a bow with a conductive string.

Figure 13:
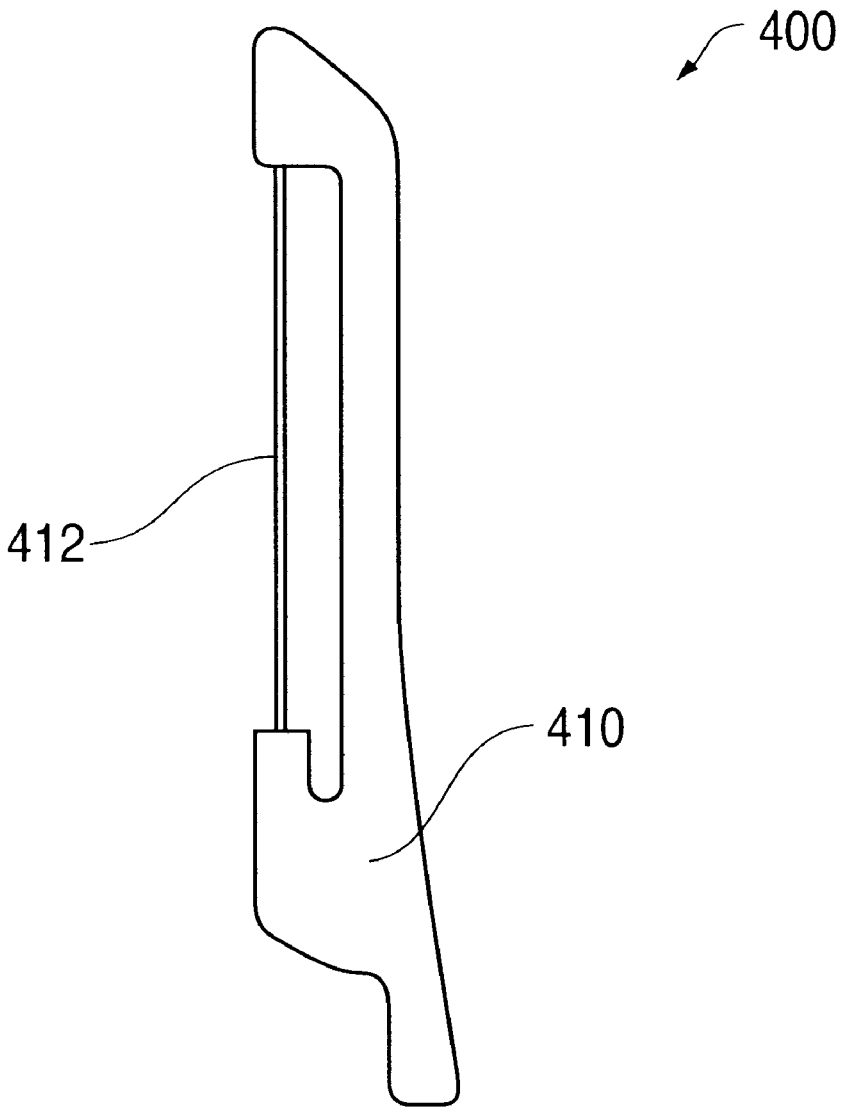
FIG. 13 illustrates a top view of an embodiment of a conductive element according to the present invention.

An implementation of a conductive element is illustrated in FIG. 13. Conductive element 400 resembles a violin bow. Conductive element 400 includes a handle 410 and a conductive string or wire 412. Referring to FIG. 12, tabs 112 and 114 on the base 100 are used to retain the conductive element 400 in the cavity 110. The bottom surface 108 also includes a battery compartment 116 that houses batteries to supply power to the musical device 90.

In the illustrated embodiment, the base 100 includes an extending portion 160 that extends from end 103 of the base 100. Extending portion 160 includes cam members 162 and 164 disposed thereon.

As illustrated in FIG. 12, head 260 is coupled to the movable member 200 at pivot point 268 by a conventional fastener, such as a screw. Head 260 can pivot along the direction of arrow "B" in FIG. 12. Head 260 includes ends 262 and 264 and a cam member 266 coupled to end 264. When the movable member 200 is in its retracted position 230, head 260 can be turned so that cam member 266 engages cams 162 and 164 on base 100, thereby reducing the force needed to remove the roller from a detent and move the movable member 200 from its retracted position 230.

Figure 14:
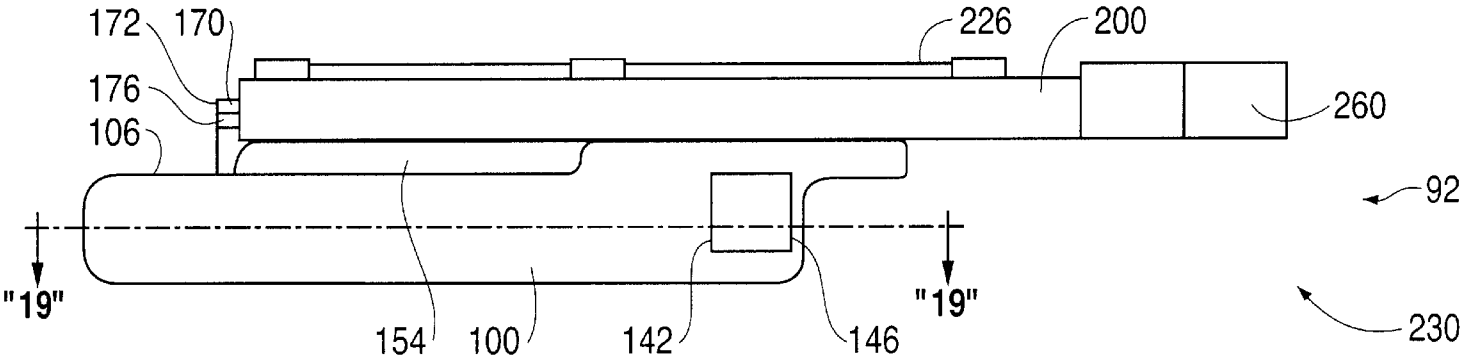
FIG. 14 illustrates a side view of the musical device of FIG. 10 disposed in a first configuration.
Figure 15:
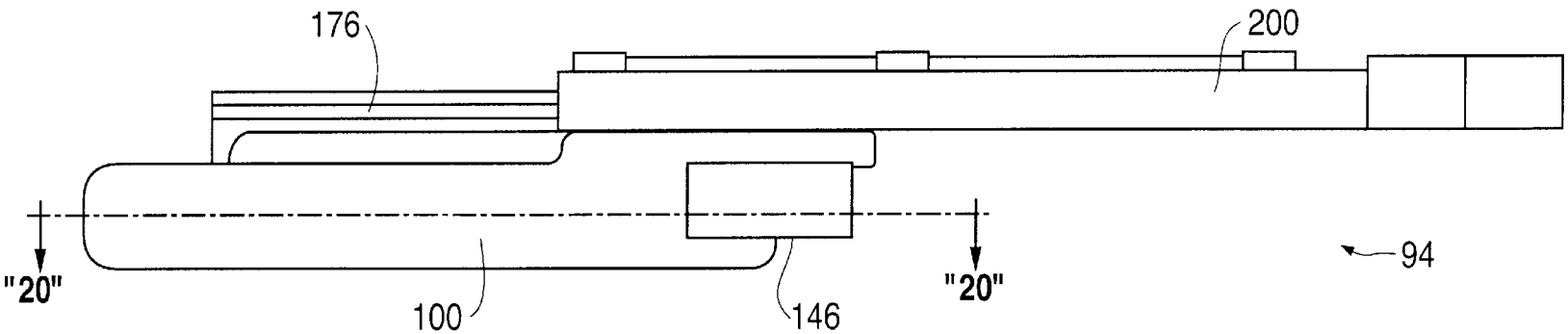
FIG. 15 illustrates a side view of the musical device of FIG. 11 disposed in a second configuration.

Musical device 90 is illustrated is its first configuration 92 and its second configuration 94 in FIGS. 14 and 15, respectively. In the illustrated embodiment, support 170 includes side surfaces 172 and 174 with shoulders 176 and 178. Support 170 and the upper surface 106 of the base 100 define a channel 154 therebetween in which plates 150 and 152, illustrated in FIGS. 10 and 11, are positioned.

Figure 16:
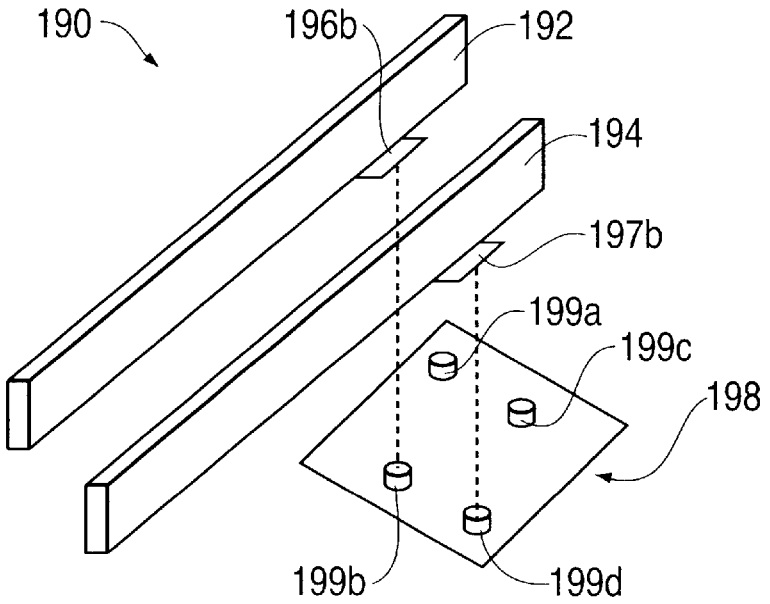
FIG. 16 illustrates an exploded perspective view of an actuator mechanism embodying the principles of the invention.
Figure 17:
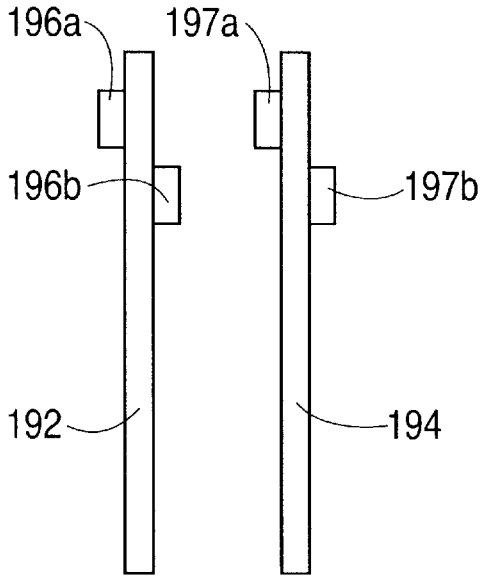
FIG. 17 illustrates an embodiment of the contact members of the actuator mechanism of FIG. 16.

An embodiment of an actuator is illustrated in FIGS. 16 and 17. Actuator 190 includes contact members 192 and 194 and a switch 198. In the illustrated embodiment, switch 198 includes push buttons 199*a*, 199*b*, 199*c*, and 199*d*. While switch 198 is illustrated with four push buttons, the switch may include any number of push buttons.

Contact members 192 and 194 are movably mounted in grooves 184 and 186 in support 170. Contact members 192 and 194 are illustrated as straight members for reasons of simplicity only. Contact member 192 includes extensions 196*a* and 196*b* that engage push buttons 199*a* and 199*b*, respectively, when the user presses contact member 192. Similarly, contact member 194 includes extensions 197*a* and 197*b* that can engage push buttons 199*c* and 199*d*, respectively, when contact member 194 is mounted in the support 170.

Figure 18:
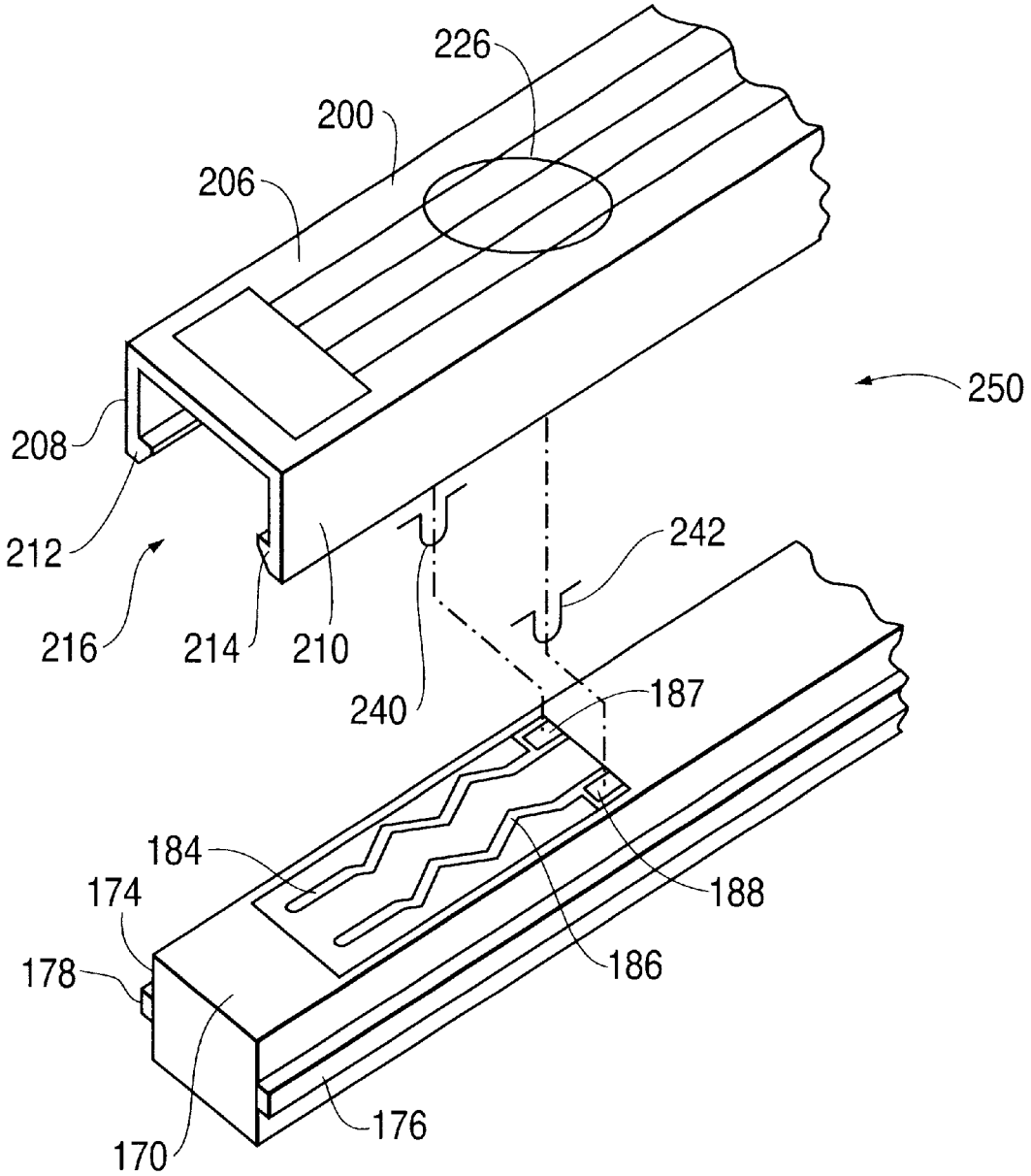
FIG. 18 illustrates an exploded perspective view of an actuator mechanism embodying the principles of the invention.

An embodiment of a movable member and an actuator is illustrated in FIG. 18. Movable member 200 includes upper wall 206 and side walls 208 and 210 that define channel 216 therebetween. Side walls 208 and 210 include tabs 212 and 214, respectively, on their inner surfaces as shown. Tab 212 engages the bottom surface of shoulder 178 on support 170. Similarly, tab 214 engages the bottom surface of shoulder 176 on support 170. The coupling of the tabs 212 and 214 with shoulders 176 and 178 enables the movable member 200 to be retained on support 170 as it slides along the base 100.

In the illustrated embodiment, actuator 250 includes conductive elements 226 disposed on movable member 200, as discussed above. Actuator 250 also includes contacts 240 and 242 that are coupled to the bottom surface of the upper wall 206. Contacts 240 and 242 are connected to the conductive elements 226.

In the illustrated embodiment, actuator 250 includes contacts or plates 187 and 188 coupled to support 170. As illustrated in FIG. 18, the contacts 187 and 188 are located at the ends of grooves 184 and 186 formed in the support 170.

As the movable member 200 is disposed in its retracted position 230, contact 240 engages contact 187 and contact 242 engages contact 188, thereby operably connecting the conductive elements 226 with the control unit 20. At this point, the user can activate the actuator 250 to produce output from the musical device 90. When the contacts 240 and 242 disengage from contacts 187 and 188, the actuator 250 cannot be activated by the user (for example, by bridging conductive elements 226 with a conductive bow).

Figure 19:
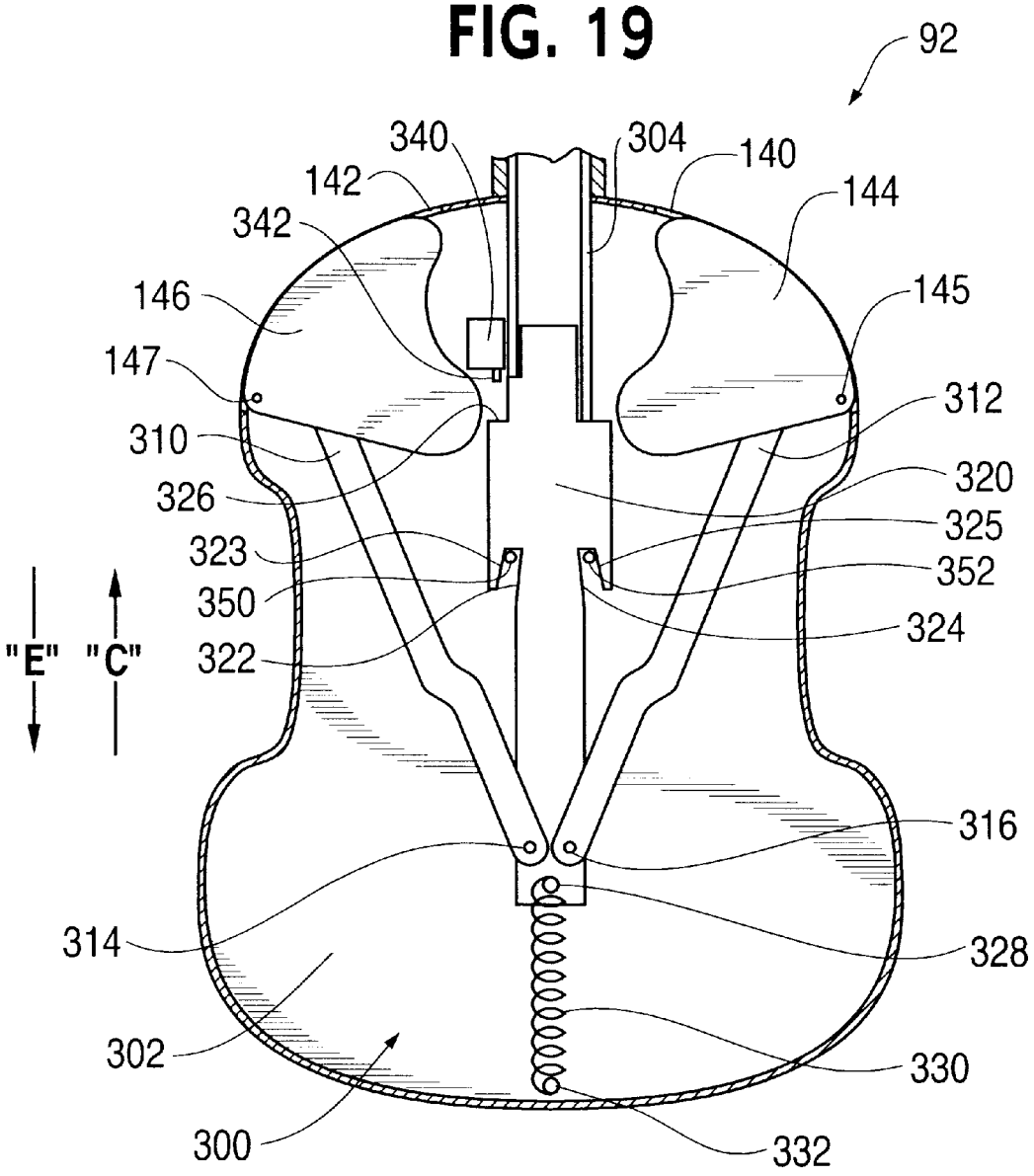
FIG. 19 illustrates a cross-sectional top view of the musical device of FIG. 14 taken along the lines "19—19."
Figure 20:
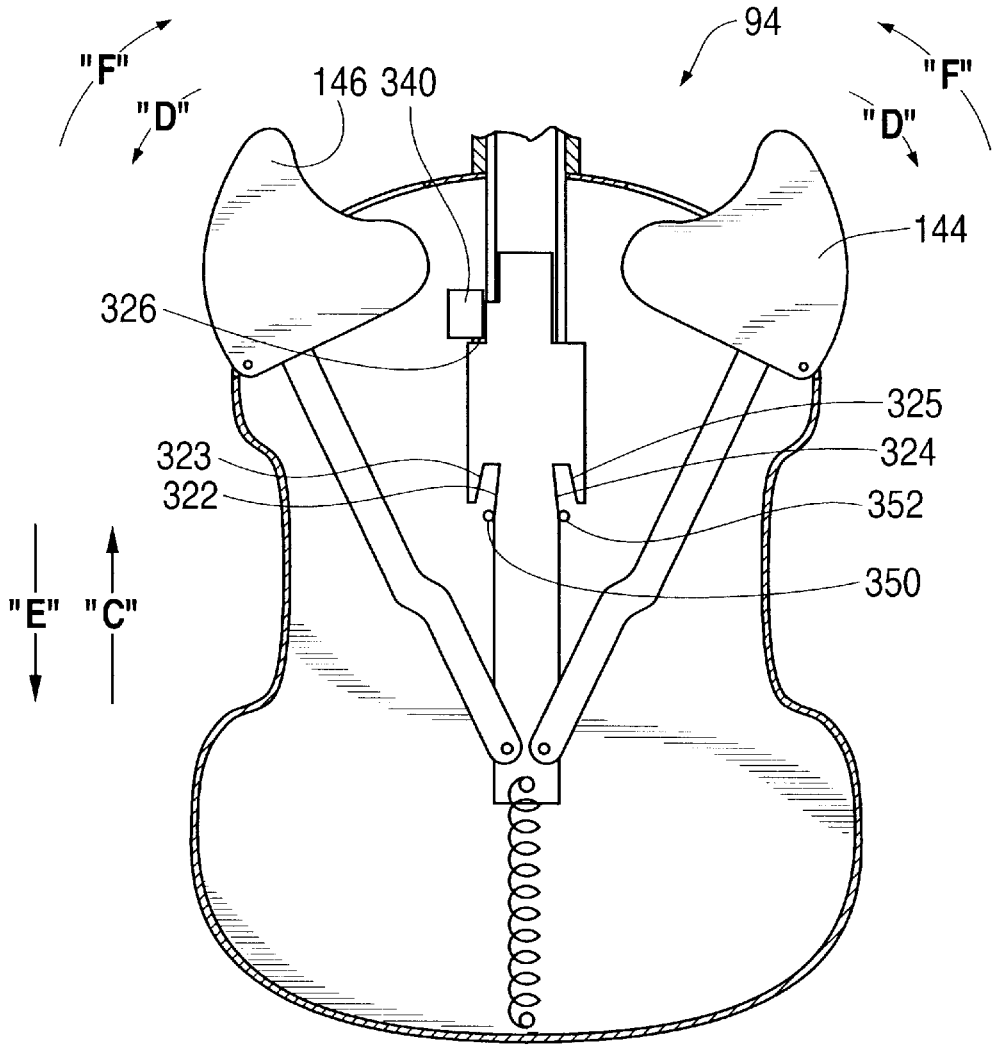
FIG. 20 illustrates a cross-sectional top view of the musical device of FIG. 15 taken along the lines "20—20."

An embodiment of the musical device is illustrated in the cross-sectional views of FIGS. 19 and 20. The upper surface 106 and lower surface 108 of the base 100 define a cavity 300 therebetween. The base 100 includes openings 140 and 142 through which wings 144 and 146 can extend. The base 100 also includes an inner surface 302 on which a track 304 is disposed. In the illustrated embodiment, track 304 is a pair of rails integrally molded with inner surface 302.

As illustrated in FIG. 19, the musical device 90 includes a cam member 320 disposed on the track 304 for movement along the track along the directions of arrows "C" and "E." In the illustrated embodiment, the cam member 320 is operably coupled to the movable member 200. Thus, cam member 320 moves along track 304 as the movable member 200 moves along the support 170.

When the movable member 200 is in its retracted configuration 230 and the musical device 90 is in its first configuration 92, the cam member 320 is in its position illustrated in FIG. 19. When the movable member 200 is in its extended configuration 232 and the musical device 90 is in its second configuration 94, the cam member 320 is in its position illustrated in FIG. 20.

In the illustrated embodiment, arms 310 and 312 are connected to the cam member 320 at joints 314 and 316, respectively. The opposite ends of arms 310 and 312 are internally coupled to wings 146 and 144, respectively. Wings 146 and 144 are pivotally mounted on the base 100 at pivot joints 147 and 145. Thus, as cam member 320 moves along the direction of arrow "C", the wings 144 and 146 pivot outwardly along the direction of arrow "D" to their positions illustrated in FIG. 20. As cam member 320 moves along the direction of arrow "E", the wings 144 and 146 pivot inwardly along the direction of arrow "F."

As illustrated in FIG. 19, cam member 320 includes several cam surfaces, including cam surface 326 and angled cam surfaces 322, 323, 324, and 325. Cam member 320 includes a post 328 to which a first end of a spring 330 is connected. The inner surface 302 of the base 100 includes a post 332 to which a second end of spring 330 is connected. The spring 330 biases the cam member 320 into its position illustrated in FIG. 19.

In one embodiment, the musical device 90 includes posts 350 and 352 that are coupled to plates 152 and 150, respectively. As cam member 320 moves along arrow "C", angled cam surfaces 322 and 324 drive posts 350 and 352 laterally outwardly. The lateral movement of posts 350 and 352 is converted into outward pivoting movement of the plates 150 and 152 (see FIG. 11) as the movable member 200 moves from its first position 230 to its second position 232. As cam member 320 moves along arrow "E," angled cam surfaces 323 and 325 drive posts 350 and 352, laterally inwardly. Thus, the plates 150 and 152 pivot inwardly to their positions illustrated in FIG. 10.

In the illustrated embodiment, the musical device 90 includes a switch 340 that is coupled to the inner surface 302 of the base 100. In this embodiment, switch 340 is a push button switch with a button 342 extending therefrom. As the cam member 320 moves along arrow "C" to its position illustrated in FIG. 20, cam surface 326 engages push button 342, thereby closing the switch 340. When the cam member 320 is this position, switch 340 is closed and actuator mechanism 190 is rendered operable.

Figure 21:
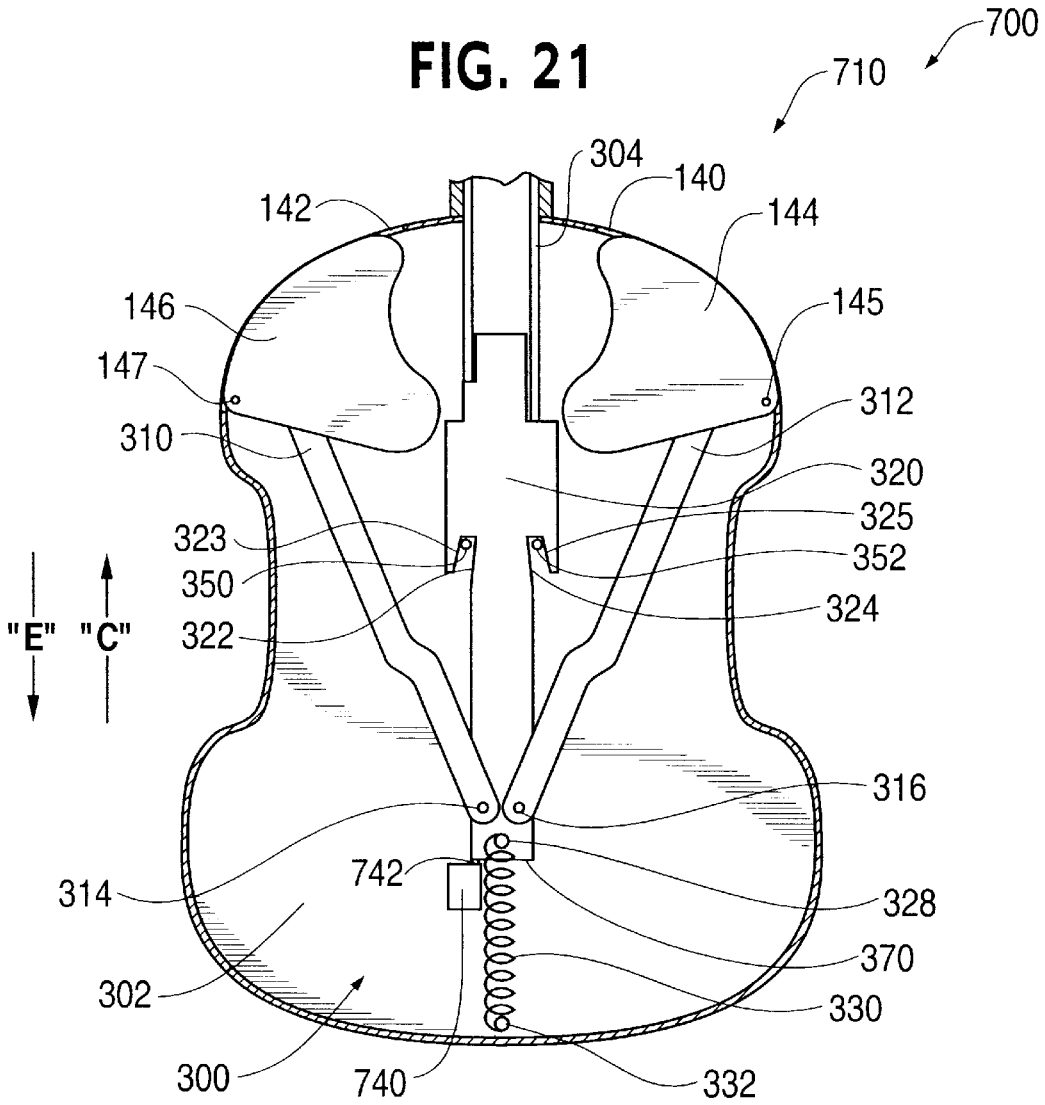
FIG. 21 illustrates a cross-sectional top view of an alternative embodiment of the musical device of FIG. 14.
Figure 22:
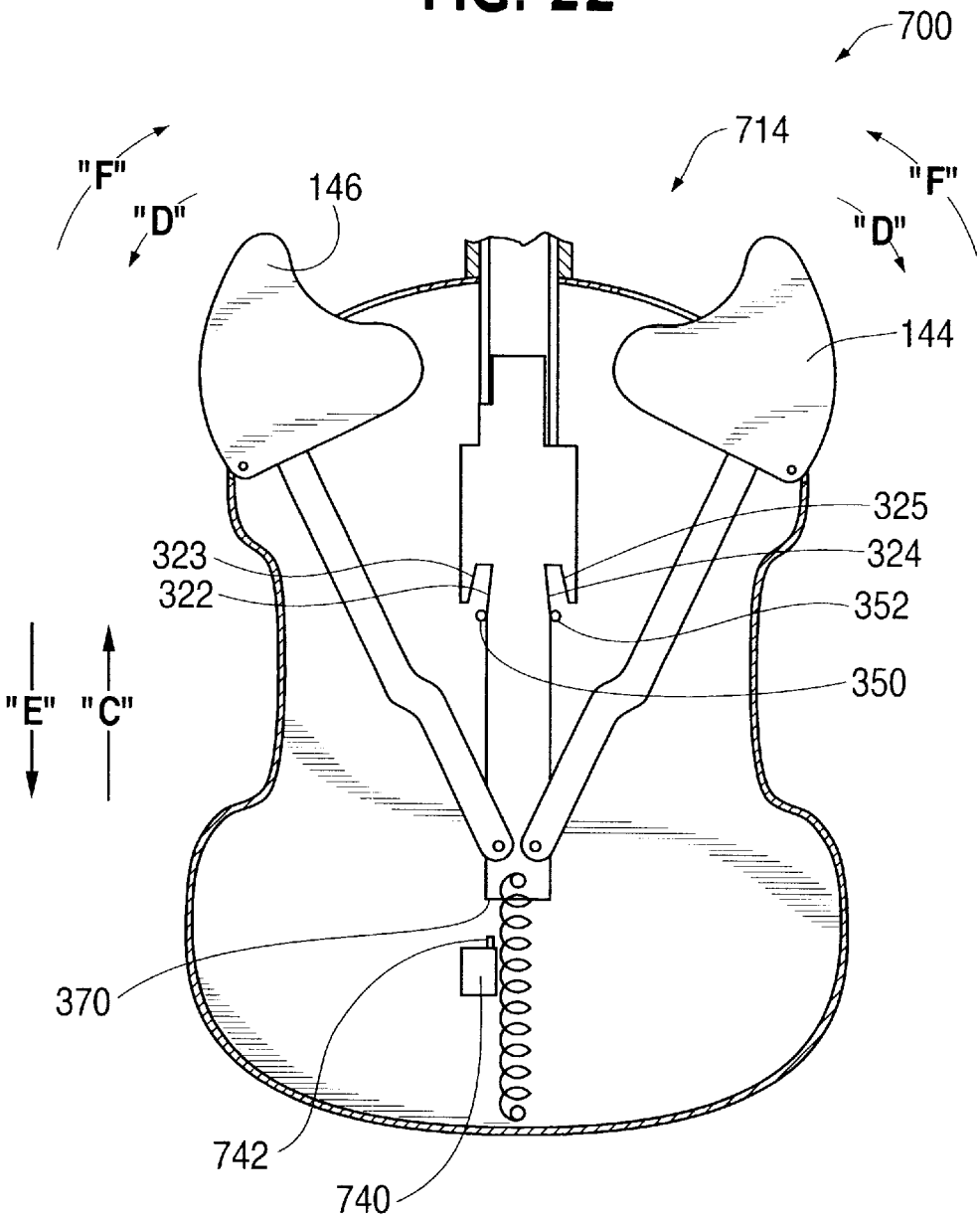
FIG. 22 illustrates a cross-sectional top view of an alternative embodiment of the musical device of FIG. 15.

An alternative embodiment of the musical device is illustrated in the cross-sectional views of FIGS. 21 and 22. FIGS. 21 and 22 illustrate some of the components of the musical device 700. Similar reference numbers are utilized for those components of musical device 700 that are similar to components in musical device 90, as illustrated in FIGS. 19 and 20.

In this embodiment, musical device 700 includes a switch 740 disposed on the inner surface 302. Switch 740 may be any conventional switch, such as a switch with a push button 742. Cam member 320 includes a contact surface 370 disposed proximate to one end of the cam member 320.

When the movable member 720 is in a retracted position and the musical device 700 is in its first configuration 710, the cam member 320 is in its position illustrated in FIG. 21. When the movable member 720 is in an extended position and the musical device 700 is in its second configuration 714, the cam member 320 is in its position illustrated in FIG. 22.

When the cam member 320 is in its position illustrated in FIG. 21, cam surface 370 engages push button 742, thereby closing the switch 740. When the switch 740 is closed, actuator mechanism 190 is rendered inoperable. Actuator mechanism 250 is rendered operable if contacts 240 and 242 are in contact with contacts 187 and 188.

As the cam member 320 moves along arrow "C" to its position illustrated in FIG. 22, cam surface 370 moves away from push button 742, thereby opening the switch 740. When the cam member 320 is this position, switch 740 is opened and actuator mechanism 190 is rendered operable.

Figure 23:
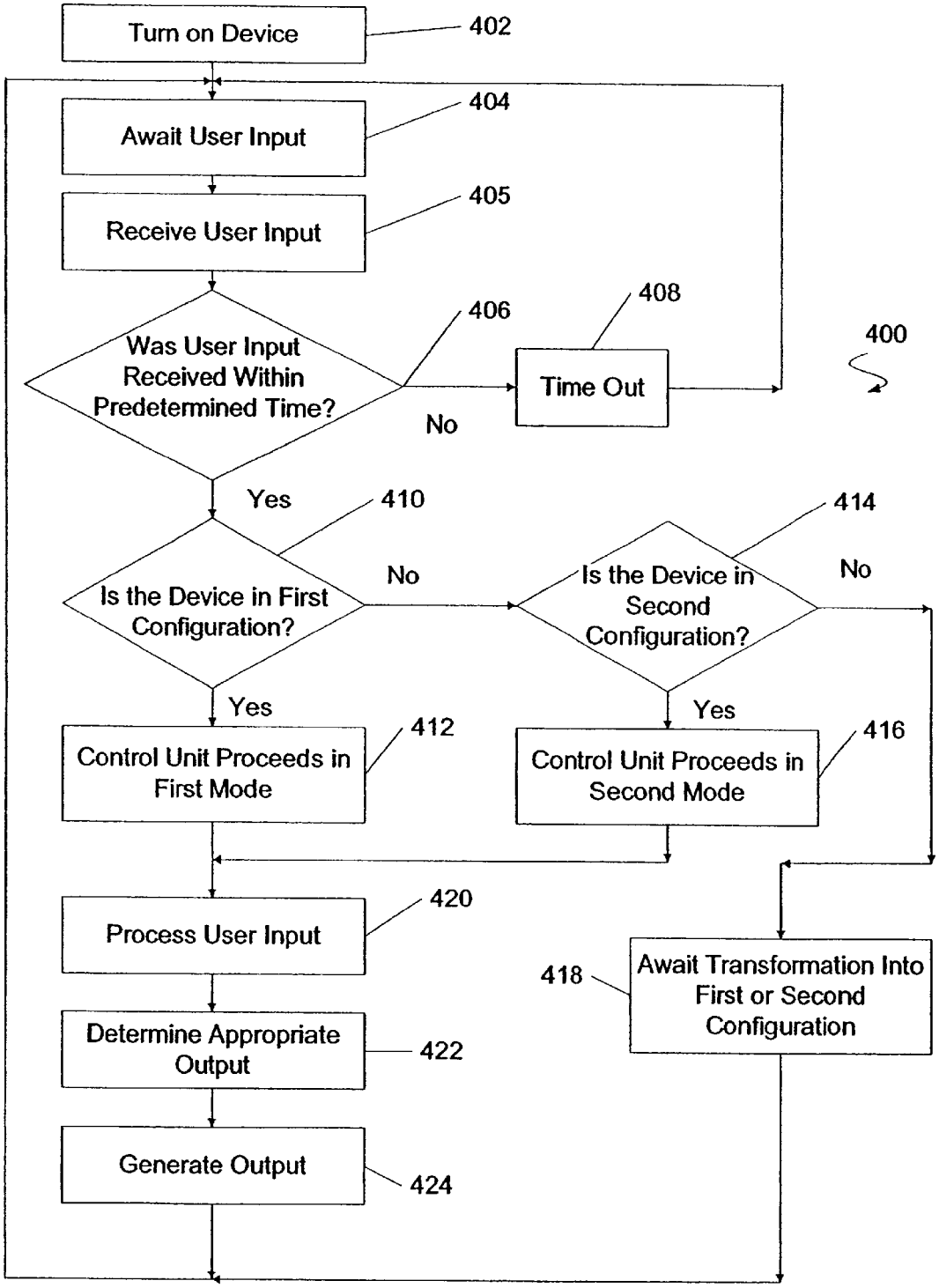
FIG. 23 illustrates a process, according to an embodiment of the present invention, by which the musical device generates an audio output.

The operation of the musical device 700 is now described. FIG. 23 illustrates a flowchart 400 of the generation of an output in response to a user input. Flowchart 400 illustrates some of the steps that are performed in the generating of an audio output. Other combinations of steps may be carried out to generate an audio output from the musical device.

At step 402, the user turns on the musical device 700 using a power control mechanism.

At step 404, the musical device 700 awaits an input from the user. The user input may be any number of forms. One type of input is when a user presses a song selection button 32 and closes a song selection switch. Another example is when a user presses a song demo or play button 30 and closes the song play switch. Another example is when the user moves the movable member 720 relative to the base 730. Another example is when the user activates an actuator mechanism. For example, a user can activate an actuator mechanism that includes conductive elements by placing a third conductive element in contact with the other conductive elements to close a circuit or switch. Also, a user can activate an actuator mechanism that includes contact members and a switch by moving a contact member to close the switch.

At step 405, the musical device 700 receives an input from the user.

At step 406, the processor 24 determines whether the particular user input was received within a predetermined amount of time after the musical device 700 is turned on. In one embodiment, the musical device 700 includes a timing mechanism that is set for a predetermined period of time, such as five seconds. The time period may be any period of time. If the user input is not received within the predetermined amount of time, the process continues to step 408.

At step 408, the musical device 700 times out and enters a power down mode. The process returns to step 404 and the musical device 700 awaits another input from the user.

If the input was received within the predetermined amount of time at step 406, the process continues to step 410. At step 410, the processor 24 determines whether the musical device 700 is in its first configuration 710. In the illustrated embodiment, the musical device 700 is in its first configuration 710 when switch 740 is closed. If the musical device 700 is in its first configuration 710, the process continues to step 412.

At step 412, the control unit 20 proceeds in a first mode of operation, which is associated with the first musical instrument. In the first mode of operation, the control unit 20 accesses in a conventional manner the pre-recorded songs that are stored in memory 22 for the first instrument. The process continues to step 420.

If the musical device 700 is not in its first configuration 710, the process continues to step 414. At step 414, the processor 24 determines whether the musical device 700 is in its second configuration 714. In the illustrated embodiment, the musical device 700 is in its second configuration 714 when switch 740 is closed. If the musical device 700 is in its second configuration 714, the process continues to step 416.

At step 416, the control unit 20 proceeds in its second mode of operation, which is associated with the second musical instrument. In the second mode of operation, the control unit 20 accesses in a conventional manner the pre-recorded songs that are stored in memory 22 for the second musical instrument. The process continues to step 420.

If the musical device 700 is not in its second configuration 714, but is in an intermediate configuration 712, then the process continues to step 418. At step 418, the musical device 700 waits for the user to dispose the musical device 700 into its first or second configuration. The process returns to step 404 and awaits another user input.

At step 420, the control unit 20 processes the user input. An exemplary implementation of step 420 is illustrated in and discussed in detail relative to FIGS. 24A–24D.

At step 422, the control unit 20 determines an appropriate output based on the user input that was received and the current configuration the musical device 700. Step 422 is also explained in greater detail relative to FIGS. 24A–24D.

At step 424, the musical device 700 generates the selected output. Signals associated with the selected output are forwarded to the speaker, which generates the selected output. Once the output is generated, the process returns to step 404 and the musical device 700 awaits another user input.

FIGS. 24A–24D illustrate a flowchart illustrated as a series of continuous flowcharts 500A–500D of the processing of a user input, the determination of an appropriate output, and the generation of the selected output. Flowcharts 500A–500D illustrate steps that are an exemplary embodiment of a process corresponding to steps 420, 422, and 424 of flowchart 400 illustrated in FIG. 23.

At step 502, the control unit 20 analyzes the user input to determine whether the input was a closing of the song selection switch. If the user input was the closing of the song selection switch, the process continues to step 504.

At step 504, the processor 24 advances to the next song stored in memory for that particular instrument. The next song is loaded into active memory or otherwise marked for access. In one embodiment, the memory includes three songs for the first musical instrument and three songs for the second instrument. When the musical device 700 is initially turned on, the first song stored for each instrument is the first one accessed by the processor 24. The process continues to step 506.

At step 506, the control unit 20 generates an audio output associated with the current instrument configuration. In the illustrated embodiment, the musical device 700 plays music as an audio output. In one embodiment, the musical device 700 plays the first two bars of music for the current song corresponding to the current instrument. For example, if the musical device 700 is in its first configuration 710 which resembles a violin, then the musical device 700 plays the first two bars of a selected song when the song selection switch is closed. The music is an indicator that the control unit 20 has advanced to the next recorded song. In another embodiment, the musical device 700 may play a single note from the currently selected song. The indicator may be any other type of indicator, including audio and visual indicators. The process continues to step 508.

At step 508, the musical device 700 awaits another user input. This step is essentially the same as returning to step 404 in flowchart 400 and illustrated in FIG. 24A.

If the user input was not a closing of the song selection switch at step 502, then the process continues to step 510. At step 510, the processor 20 determines whether the user input was the closing of the song demo switch. If the user input was the closing of the song demo switch, the process continues to step 512.

At step 512, the control unit 20 determines the appropriate audio output based on the configuration of the musical device 700. In the illustrated embodiment, the musical device 700 plays a song in response to the closing of the song demo switch. In particular, the musical device 700 plays the current or active song for the current instrument. For example, if the musical device 700 is in its violin mode or configuration and the musical device 700 has just been turned on, then the audio output is the first recorded violin song. The process continues to step 514.

At step 514, the control unit 20 generates the selected audio output. In the illustrated embodiment, the musical device 700 plays a recorded song. The process continues with step 516.

At step 516, the control unit 20 determines whether a user input is received by the musical device 700 while the song is being played. Some types of user inputs can interrupt the song as it is being played. For example, in the illustrated embodiment, the song can be interrupted if the user closes the song selection switch or closes the song demo switch. If a user input is received while the song is being played, the process continues with step 518.

At step 518, the control unit 20 interrupts the song and returns to step 405 illustrated in FIG. 23. As long as no further user input is received, the musical device 700 plays the selected song.

At step 520, the processor 24 determines whether the song has completed. Once the song ends, the process continues to step 522.

At step 522, the musical device 700 awaits another user input.

Figure 24A:
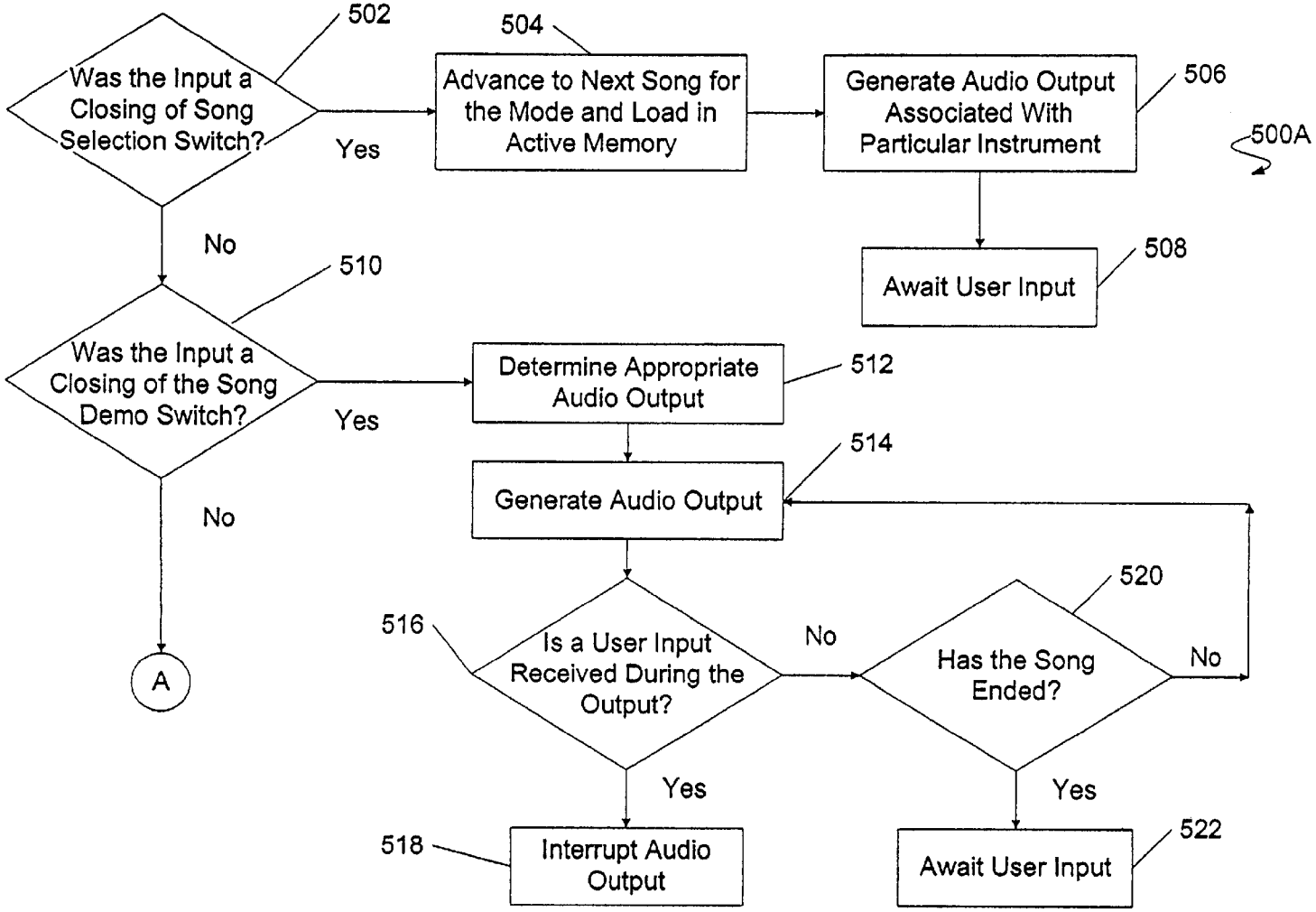
FIGS. 24A–24D illustrate a process, according to an embodiment of the present invention, by which user input is processed and an appropriate output is determined and generated.
Figure 24B:
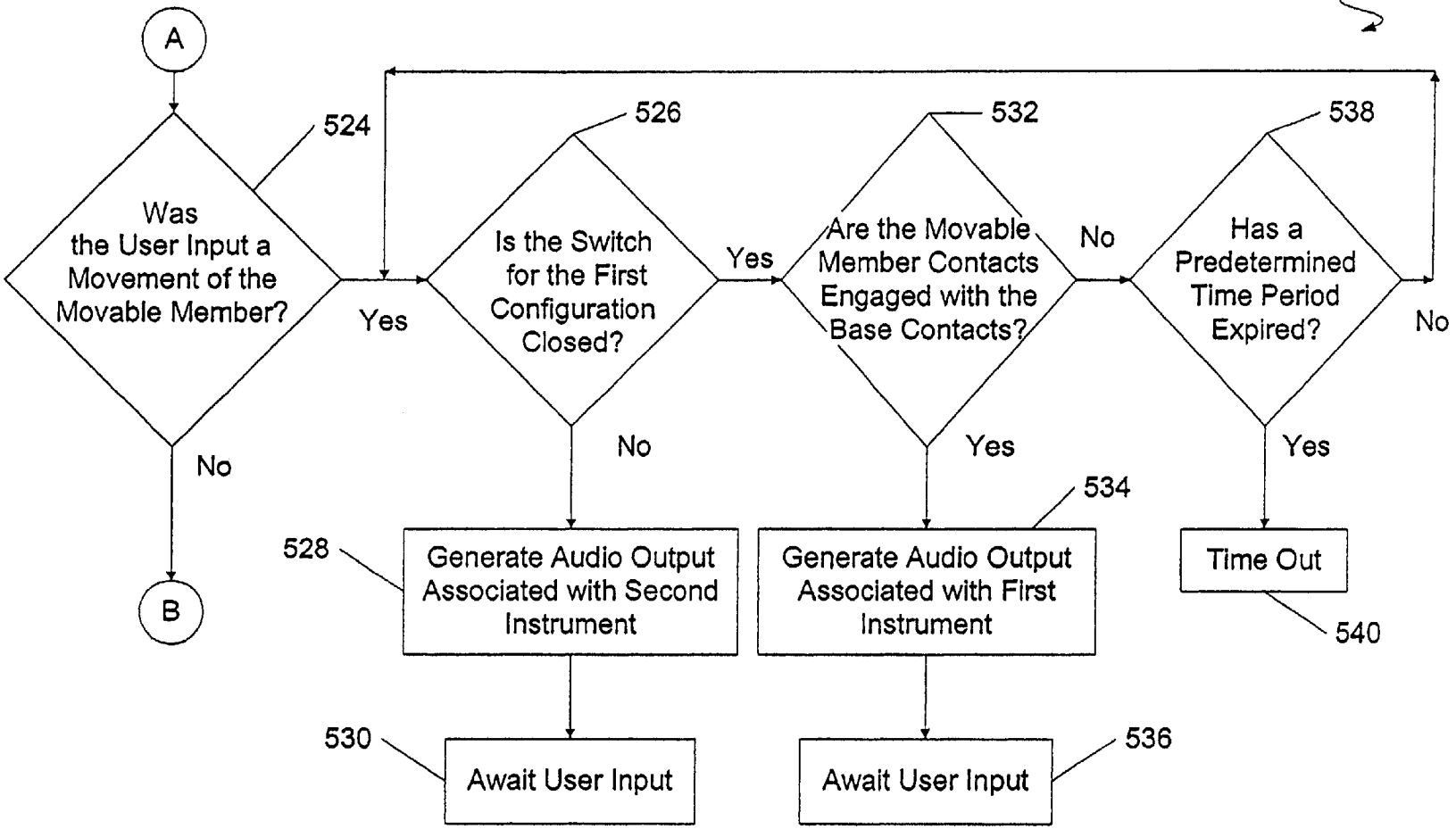

If the input was not a closing of the song demo switch, the process continues to step 524, as illustrated in FIG. 24B. At step 524, the processor 24 determines whether the user moved the movable member 720 relative to the base 730. Relative movement between the movable member 720 and the base 730 can be detected by the opening and closing of the switch 740. As previously discussed, when the musical device 700 is in its first configuration 710, switch 740 is closed. Similarly, when the musical device 700 is in its second configuration 714, switch 740 is open. As a result, when switch 740 is closed and is subsequently opened, the control unit 20 can determine that the movable member 720 and the base 730 have been moved relative to each other. If the user moved the movable member 730, the process continues to step 526.

At step 526, the control unit 20 checks whether the switch for the first configuration 710 is closed. In the illustrated embodiment, the switch for the first configuration is switch 740. If switch 740 is not closed, the process continues to step 528.

At step 528, the control unit 20 generates an audio output that is associated with the first instrument. For example, if the first instrument is a violin, then the generated audio output is a sound or sounds similar to that of a violin. In the illustrated embodiment, the generated audio output is a short sequence of notes, such as five notes. In one embodiment, the notes can be played upon the closing of the switch 740. In another embodiment, the notes can be played after a period of time after the switch 740 is closed. The process continues to step 530.

At step 530, the musical device 700 in its first configuration 710 and awaits an additional user input.

If the switch 45 is closed (see step 526), then the process continues to step 532. At step 532, the control unit 20 checks whether the contacts 240 and 242 are engaged with contacts 187 and 188. If contacts 240 and 242 engage contacts 187 and 188, the process continues to step 534.

At step 534, the control unit 20 generates an audio output that is associated with the second instrument. For example, if the second instrument is a guitar, then the generated audio output is a sound or sounds similar to that of a guitar. In the illustrated embodiment, the generated audio output is a short sequence of notes, such as five notes. In one embodiment, the notes can be played upon the opening of the switch 740. In another embodiment, the notes can be played after a period of time after the switch 740 is opened. The process continues to step 536.

At step 536, the musical device 700 in its second configuration 714 and awaits an additional user input.

If the contacts 240 and 242 do not engage contacts 187 and 188 (see step 532), then the process continues to step 538. If the movable member 720 is moved relative to the base 730 and switch 740 is not opened, the musical device 700 is in an intermediate configuration in which it does not play any sound. At step 538, the control unit 20 determines whether a predetermined time period has expired without the opening of switch 740. If the time period has expired without any input, the process continues to step 540.

At step 540, the musical device 700 times out or powers down. Otherwise, the process returns to step 526 and the control unit 20 checks whether switch 740 is closed.

Figure 24C:
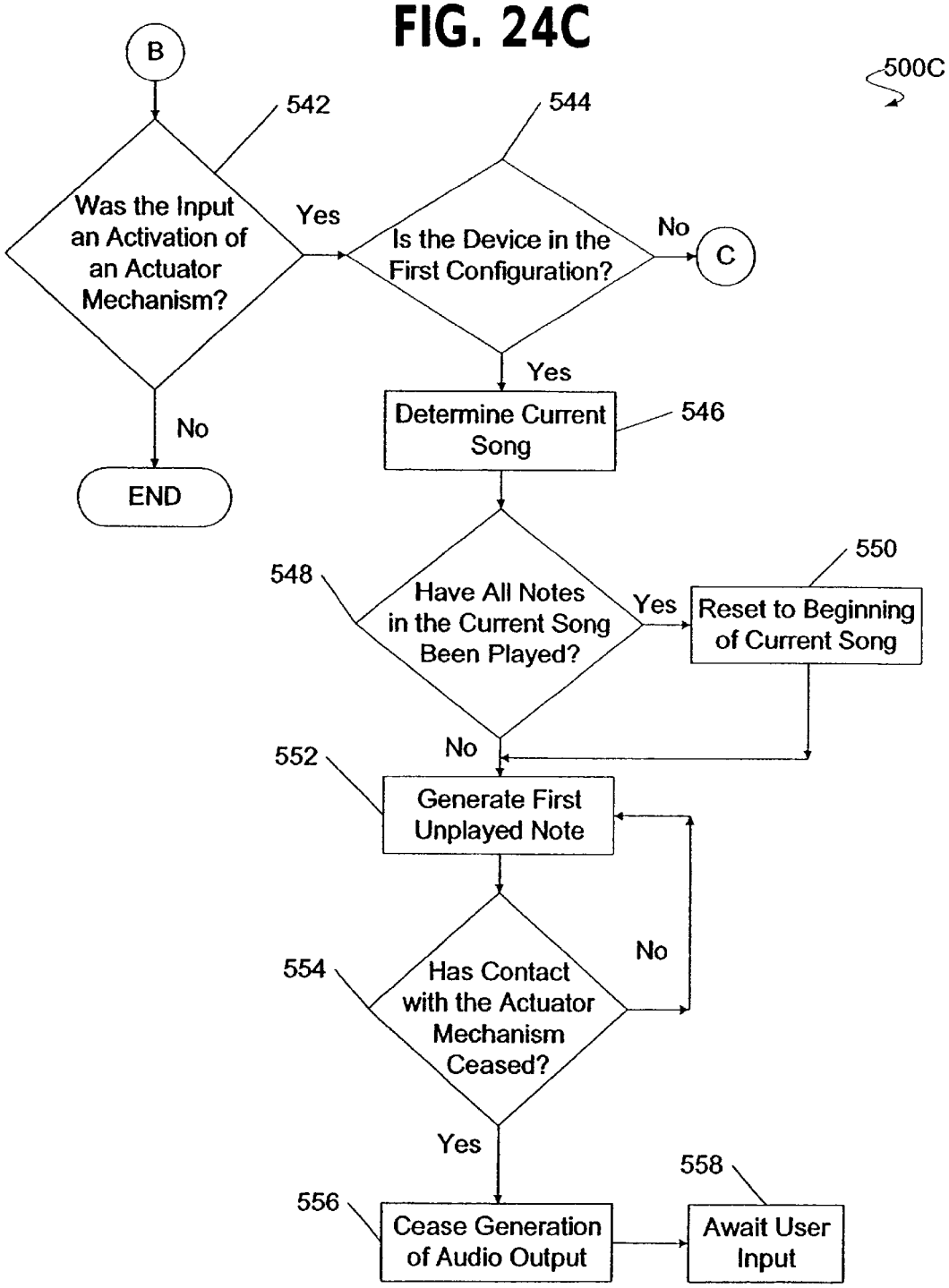

If the user did not move the movable member (see step 524), then the process continues to step 542 as illustrated in FIG. 24C. The control unit 20 analyzes the user input to determine whether the user activated an actuator mechanism. If the user activated an actuator mechanism, the process continues to step 544.

At step 544, the control unit 20 determines the musical device 700 is in its first configuration 710. If the musical device 700 is in its first configuration 710, the process continues to step 546.

At step 546, the processor 24 identifies the current or active song. The process continues with step 548.

At step 548, the processor 24 determines whether all of the notes in the current song have been played. In the illustrated embodiment, the processor 24 monitors which notes in a song have been played in a conventional manner. If all of the notes in the current song have been played, the process continues to step 550.

At step 550, the processor 24 returns to the beginning of the current song so that the next note played from the song is the first recorded note. In the illustrated embodiment, the musical device 700 loops through the current song until the song selection button is pressed to advance to the next recorded song. In an alternative embodiment, the processor 24 advances to the next song stored in memory upon the completion of the previous song.

At step 552, the musical device 700 plays the first unplayed note. In the illustrated embodiment, in the first mode, the musical device 700 plays the note as long as the actuator mechanism is activated. For example, in one embodiment, the musical device 700 in the first configuration is a violin that has conductive elements 226 as part of a first actuator mechanism 250. When the user contacts two of the conductive elements 226 with third conductive element (e.g., a conductive bow), a note is played. The musical device 700 plays the note as long as the user maintains the three conductive elements in contact with each other. The musical device 700 ceases playing the note when contact between the elements is broken.

At step 554, the control unit 20 determines whether contact between the conductive elements is broken. If contact is not broken, the process continues with step 552 and the musical device continues to play the note. If contact is broken, the process continues with step 556.

At step 556, the musical device 700 stops playing the note. The process continues to step 558 and awaits an additional user input.

Figure 24D:
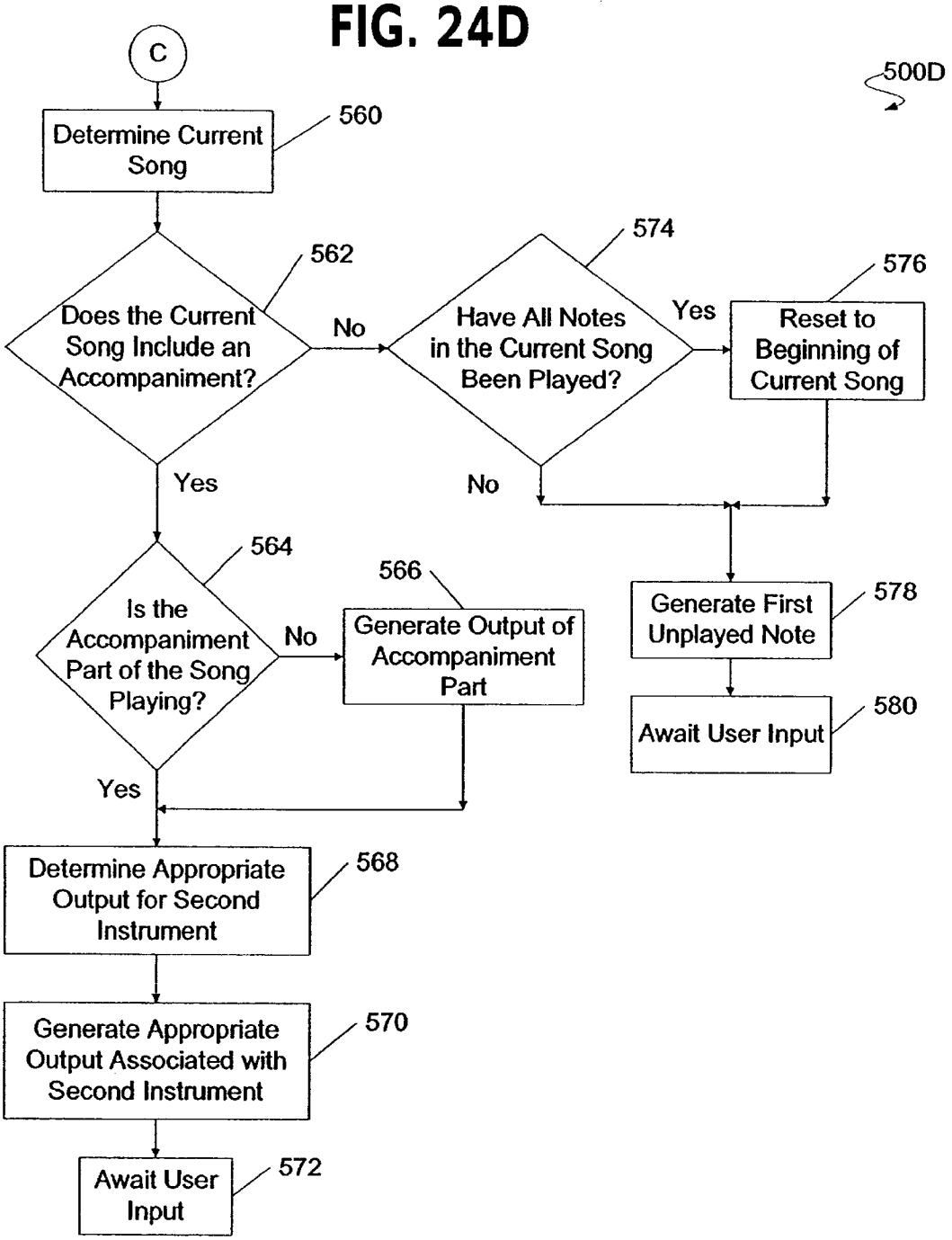
Figure 25:
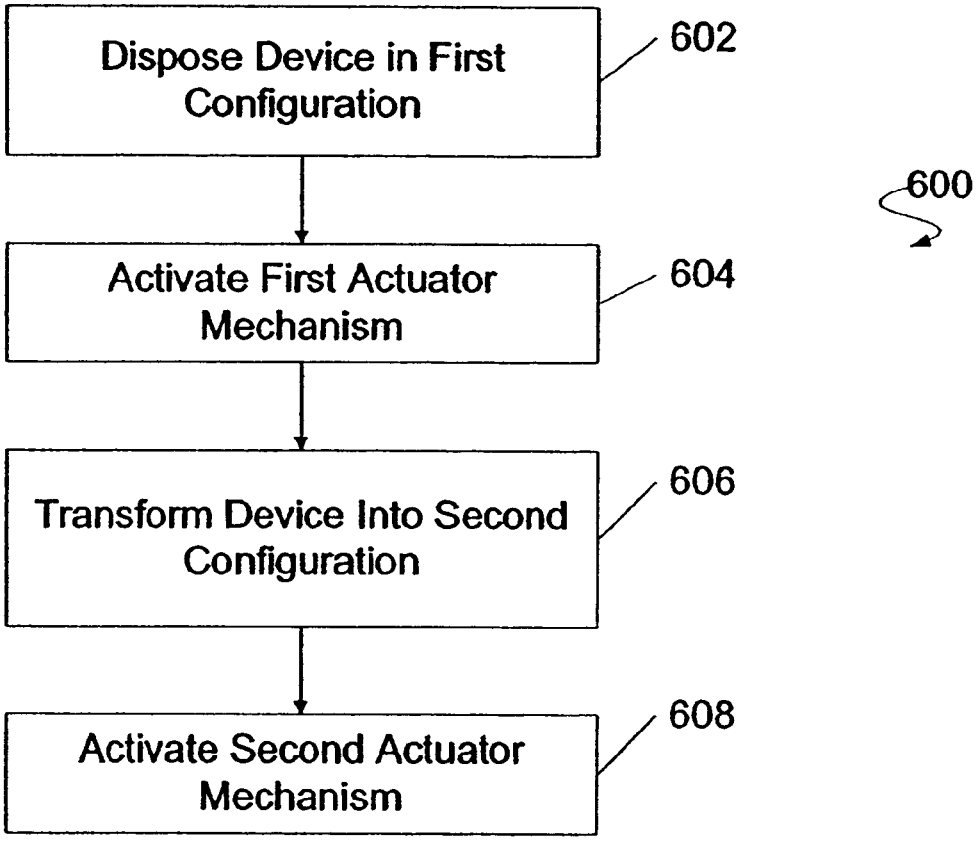
FIG. 25 illustrates a process, according to an embodiment of the present invention, by which the musical device can be used.

Returning to step 544, if the musical device 700 is not in its first configuration 710, the process continues to step 560 as illustrated in FIG. 24D. At step 560, the musical device 700 is in its second configuration 714, and the processor 24 identifies the current or active song. The process continues with step 562.

At step 562, the processor 24 determines whether the current or active song includes a recorded part for one or more accompanying instruments. In the illustrated embodiment, the musical device 700 resembles a guitar in its second configuration. Two versions of each song are stored for the second instrument. In both versions, the songs are recorded so that the guitar plays the melody of each version. In the second version of each song, an accompanying instrument part is recorded and stored with the melody. The accompaniment part may include notes for one or more different instruments, such as a piano, keyboard, etc.

If the current song is a version of a song with an accompaniment, the process continues to step 564. At step 564, the processor 24 determines whether the accompaniment part of the song is playing. In the illustrated embodiment, when a user activates the actuator mechanism 190 to play a note in a song, the accompaniment part of the song is played as well. Once the song is started, the musical device 700 continues to play the accompaniment part of the song, even if the user does not further activate the actuator mechanism 190. If the accompaniment part of the song is not currently playing, the process continues to step 566.

At step 566, the musical device 700 generates the output associated with the accompaniment part. In the illustrated embodiment, the accompaniment output is the background music for the current or active song. In an alternative embodiment, the output may be a riff or other sequence of notes.

At step 568, the processor 24 determines the appropriate output for the second instrument. In the illustrated embodiment, the second instrument plays the melody of the current or active song. While the accompaniment part keeps playing, a predetermined amount of music for the second instrument is played for each activation of the actuator mechanism 190. In the illustrated embodiment, one second of music is played for each activation. The number of musical notes in one second of music depends on the particular section of a song. Since the accompaniment part keeps playing, the processor 24 determines the appropriate music to play in response to a user input. For example, if the user activates the actuator mechanism 190 once and then waits one minute and activates it again, the accompaniment part is played for that entire minute. The processor 24 determines the appropriate location in the melody based on the corresponding location in the accompaniment part. Once the appropriate music is determined, the process continues to step 570.

At step 570, the musical device 700 plays the selected music for the second instrument. The process continues to step 572.

At step 572, the musical device awaits an additional user input.

Returning to step 562, if the current or active song does not include an accompaniment part, the process continues to step 574. At step 574, the processor 24 monitors which notes in a song have been played in a conventional manner. If all of the notes in the current song have been played, the process continues to step 576.

At step 576, the processor 24 returns to the beginning of the current song so that the next note played from the song is the first recorded note. In the illustrated embodiment, the musical device 700 loops through the current song until the song selection button is pressed to advance to the next recorded song. In an alternative embodiment, the processor 24 advances to the next song stored in memory 22 upon the completion of the previous song.

At step 578, the musical device 700 plays the first unplayed note. The process continues to step 580.

At step 580, the musical device 700 awaits an additional user input.

The criteria and method of processing user input and the determining and generating an appropriate output can vary. The description of flowcharts 500A–500D is intended to be illustrative and not limiting in scope.

A method of using the musical device 700 is now described. FIG. 18 illustrates a flowchart 600 of an exemplary method of using of the musical device 700.

At step 602, the user disposes the musical device 700 in its first configuration 710. In the illustrated embodiment, the user moves the movable member 720 along the base 730 to its first position. In this position, switch 740 is closed and actuator mechanism 60 is operably connected to the control unit 20. In the illustrated embodiment, the musical device 700 resembles a violin in its first configuration 710.

At step 604, the user activates a first actuator mechanism 250. In one embodiment, the user can place a conductive element in contact with two conductive elements 226 to activate the actuator mechanism 250.

At step 606, the user transforms the musical device 700 into its second configuration 714. In the illustrated embodiment, the user moves the movable member 720 along the base 730 to a second position. In this position, switch 740 is opened and actuator 70 is operably connected to the control unit 20. In the illustrated embodiment, the musical device 700 resembles a guitar in its second configuration 714.

At step 608, the user activates a second actuator mechanism 190. In one embodiment, the user moves a contact member 192 into contact with a switch 198 to close the switch 198 and activate the actuator mechanism 190.

Many possible variations on the particular embodiments described above would be consistent with the principles of the invention. Several additional variations are described below.

The musical device can be formed to have more than two musical instrument configurations. Similarly, the musical device may generate audio outputs for more than two musical instruments.

The locations and types of switches used to identify different configurations of the musical device can vary. For example, while the switches are disclosed as different in the illustrated embodiment, both of the switches may be the same.

The musical device may generate output other than or in addition to audio in response to a user input. For example, the musical device may include lamps and generate visual output in addition to an audio output.

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents.

What is claimed is:

1. A musical device having a first configuration resembling a first musical instrument and a second configuration resembling a second musical instrument, the musical device comprising:

a base, said base having a first side and a second side opposite said first side;

a first actuator coupled to said first side of said base, said musical device generating an audio output associated with the first musical instrument in response to activation of said first actuator;

a movable member disposed on and movably coupled to said base, said movable member being movable along said first side of said base, said movable member being selectively disposable in a first position corresponding to the first configuration and a second position corresponding to the second configuration, said movable member being coupled to said base in said first position and in said second position, the first musical instrument being different from said second musical instrument; and a second actuator coupled to said movable member and disposed proximate to said first side of said base, said musical device generating an audio output associated with the second musical instrument in response to activation of said second actuator.

2. The musical device of claim 1 wherein said first actuator includes a switch disposed in said base and a plurality of contact members engageable with said switch, each of said contact members engaging said switch upon activation by a user.

3. The musical device of claim 1 wherein said second actuator includes first and second conductive elements, said musical device generating an audio output when a third conductive element contacts said first and second conductive elements simultaneously.

4. The musical device of claim 3 wherein said musical device ceases generating said audio output upon removal of said third conductive element from one of said first and second conductive elements.

5. The musical device of claim 2 wherein said movable member covers said first actuator when said movable member is in said first position.

6. The musical device of claim 1, said first actuator being operable only when the musical device is in the first configuration.

7. The musical device of claim 6 wherein said second actuator is operable only when the musical device is in the second configuration.

8. The musical device of claim 1 wherein said first instrument is a guitar and said second instrument is a violin.

9. The musical device of claim 1 further comprising:

a cam coupled to said movable member; and a switch disposed on said base, said cam engaging said switch when said movable member is in said first position, said first actuator being operable when said switch is engaged by said cam.

10. The musical device of claim 1, wherein a portion of said base resembles a neck of a guitar, a portion of said movable member resembles a neck of a violin, said movable member portion being slidable along said base portion.

11. A method of adjusting a musical device between a first instrument configuration and a second, different instrument configuration, the musical device including a base having a first side and a second, opposite side, a movable member disposed on and coupled to the base, the movable member being movable along the first side of the base, the movable member being selectively disposable in a first position along the first side of the base in the first instrument configuration and a second position along the first side of the base in the second instrument configuration, the movable member being coupled to the base in the first position and in the second position, the musical device including a first actuator disposed on the first side of the base and a second actuator coupled to the movable member, the movable member covering the first actuator when the movable member is in the first position, the method comprising:

disposing the musical device in the first instrument configuration; and moving the movable member from the first position to the second position along the first side of the base, thereby transforming the musical device into the second instrument configuration.

12. The method of claim 11 wherein said moving the movable member includes rendering the first actuator inoperable.

13. The method of claim 12 wherein said moving the movable member includes rendering the second actuator operable.

14. The method of claim 11 wherein the musical device includes a first contact disposed on the base and a second contact disposed on the movable member, and said disposing the musical device includes engaging the first contact with the second contact.

15. The method of claim 14 wherein said moving the movable member includes disengaging the first contact and the second contact.

16. The method of claim 11 wherein the musical device includes a switch disposed on the base and a cam member coupled to the movable member, and said moving the movable member includes disengaging the cam member from said switch.

17. A method of generating audio outputs representative of first and second musical instruments from a musical device including a base having a first side and a second, opposite side and a movable member disposed on and movably coupled to the first side of the base, the base including a first actuator coupled to the first side of the base, the movable member being selectively disposable in a first position with respect to and in contact with the base and in a second position with respect to and in contact with the base, the movable member including a second actuator coupled thereto, the method comprising:

actuating the first actuator to generate an audio output associated with the first musical instrument;

moving the movable member along the first side of the base from the first position to the second position to change the musical instrument from a first configuration resembling the first musical instrument to a second configuration resembling the second musical instrument; and actuating the second actuator to generate an audio output associated with the second musical instrument, the first musical instrument being different from the second musical instrument.

18. The method of claim 17 wherein the first actuator includes a switch disposed on the base and a plurality of contact members engageable with the switch, and said actuating a first actuator includes moving at least one of the plurality of contact members into engagement with the switch.

19. The method of claim 17 wherein the second actuator includes first and second conductive elements, and said actuating a second actuator includes contacting a third conductive element with the first and second conductive elements.

20. The method of claim 17 wherein said moving the movable member includes generating an audio output associated with the second musical instrument.

21. The method of claim 17 further comprising:

moving the movable member from the second position to the first position;

generating a first audio output associated with the first musical instrument; and actuating the first actuator coupled to the movable member to generate a second audio output associated with the first musical instrument.

22. The method of claim 17 wherein a portion of said base resembles a neck of a guitar and a portion of said movable member resembles a neck of a violin, and said moving the movable member includes moving the movable member portion along the base portion.

23. A musical device comprising:

a body including a base and a movable member, said base having a first side and a second, opposite side, said movable member being disposed on and movably coupled to said first side of said base, said movable member being selectively disposable with respect to said base in a first position and in a second position, said movable member being in contact with said base in said first position and in said second position, said body having a first configuration resembling a first musical instrument and a second configuration resembling a second musical instrument, said first musical instrument being different from said second musical instrument, said first position of said movable member corresponding to said first configuration, said second position of said movable member corresponding to said second configuration;

a first actuator coupled to said first side of said base, said musical device generating an audio output associated with said first musical instrument when said first actuator is engaged by a user; and a second actuator coupled to said movable member, said musical device generating an audio output associated with said second musical instrument when said second actuator is engaged by a user.

24. The musical device of claim 23 further comprising:

a switch disposed on said body, said switch being closed when said movable member is in said first position and being open when said movable member is not in said first position.

25. The musical device of claim 24 wherein said switch includes a first contact disposed on said base and a second contact disposed on said movable member, said switch being closed when said first contact engages said second contact, said first actuator being operable when said switch is closed.

26. The musical device of claim 23 further comprising:

a switch disposed on said base; and a cam disposed on said movable member, said cam engaging said switch when said movable member is in said second position, said second actuator being operable upon said cam engaging said switch.

27. The musical device of claim 23, said movable member covering said second actuator when said movable member is in said first position.

28. The musical device of claim 23, wherein a portion of said base resembles a neck of a guitar, a portion of said movable member resembles a neck of a violin, said movable member portion being slidable along said base portion.

29. A method of generating an audio output from a musical device having a first musical instrument configuration and a second musical instrument configuration, the musical device including a base having a first side and a second, opposite side, a movable member disposed on and movably coupled to the base, a memory disposed in the base, and a plurality of pre-recorded songs stored in the memory, the movable member being movable along the first side of the base between a first position corresponding to the first musical instrument configuration and a second position corresponding to the second musical instrument configuration, the method comprising:

generating a first audio output in response to a first user input when the movable member is in the first position, the first audio output corresponding to a first pre-recorded song, the first audio output being associated with a first musical instrument; and generating a second audio output in response to the first user input when the movable member is in the first position, the second audio output corresponding to the first pre-recorded song, the second audio output being associated with a second musical instrument, the first musical instrument being different from the second musical instrument.

30. The method of claim 29 further comprising:

associating the first audio output with the second audio output so that the first audio output corresponds to said second audio output; and generating a third audio output in response to a second user input, the third audio output corresponding to the first pre-recorded song, the third audio output including a note from the first pre-recorded song that corresponds to the current location of the second audio output.

31. The method of claim 29 wherein the first audio output is representative of a guitar and the second audio output is representative of an accompanying instrument.

* * * * *